US007806148B1

(12) United States Patent
Yamashita

(10) Patent No.: US 7,806,148 B1
(45) Date of Patent: Oct. 5, 2010

(54) CARRIER RAPIER

(75) Inventor: Ryoji Yamashita, Kanazawa (JP)

(73) Assignee: Tsudakoma Kogyo Kabushiki Kaisha, Kanazawa-shi (JP)

( * ) Notice: Subject to any disclaimer, the term of this patent is extended or adjusted under 35 U.S.C. 154(b) by 0 days.

(21) Appl. No.: 12/751,763

(22) Filed: Mar. 31, 2010

(30) Foreign Application Priority Data

Apr. 28, 2009 (JP) ..... 2009-108705

(51) Int. Cl.
*D03D 47/20* (2006.01)
*D03D 47/23* (2006.01)
*D03D 47/00* (2006.01)
*D03D 47/24* (2006.01)

(52) U.S. Cl. ..... 139/448; 139/449

(58) Field of Classification Search ..... 139/448, 139/449

See application file for complete search history.

(56) References Cited

U.S. PATENT DOCUMENTS 3,602,266 A * 8/1971 Duplessy ..... 139/446
3,844,316 A * 10/1974 Palencher ..... 139/429
3,861,427 A * 1/1975 Scheidecker ..... 139/448
3,931,837 A * 1/1976 Volpe ..... 139/448
4,226,265 A * 10/1980 Zollinger ..... 139/448
4,699,183 A * 10/1987 Menzel ..... 139/449
4,785,856 A * 11/1988 Gehring et al. ..... 139/453
5,318,077 A * 6/1994 Yamashita ..... 139/449
5,415,206 A * 5/1995 Egloff ..... 139/196.2
5,862,837 A * 1/1999 Guenther et al. ..... 139/448
6,845,792 B2 * 1/2005 Scari et al. ..... 139/448
2003/0183297 A1 * 10/2003 Scari et al. ..... 139/448
2008/0105326 A1 * 5/2008 D'Incau et al. ..... 139/448

FOREIGN PATENT DOCUMENTS

JP 57-77353 A 5/1982

* cited by examiner

*Primary Examiner*—Bobby H Muromoto, Jr.
(74) *Attorney, Agent, or Firm*—Westerman, Hattori, Daniels & Adrian, LLP

(57) ABSTRACT

In a carrier rapier including a rapier head having a hook-shaped tip, a weft holding portion and a weft guiding portion are formed. The weft holding portion has a wedge-shaped gap formed by an opposing surface of a catch lever and a base surface at a turn-back portion of the carrier rapier. The weft guiding portion guides a weft from the exterior of the carrier rapier to the weft holding portion. In addition, a weft interfering portion is provided between the weft guiding portion and the weft holding portion. An angle θ2 formed by the base surface and the opposing surface at the weft interfering portion is less than a maximum angle θ1 formed by the base surface and the opposing surface at the weft holding portion.

19 Claims, 15 Drawing Sheets

| | | CROSS SECTION X–X | CROSS SECTION Y–Y |
|---|---|---|---|
| FIG. 19A | FLAT SURFACE AND FLAT SURFACE | 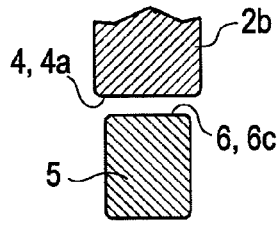 | 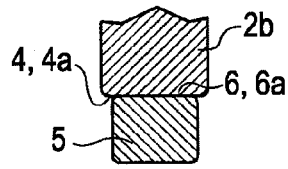 |
| FIG. 19B | FLAT SURFACE AND GROOVED SURFACE | 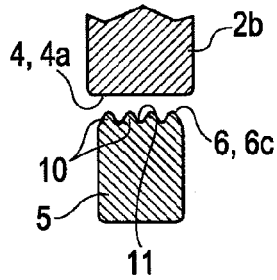 | 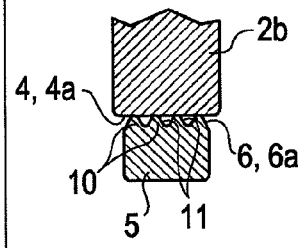 |
| FIG. 19C | GROOVED SURFACE AND GROOVED SURFACE | 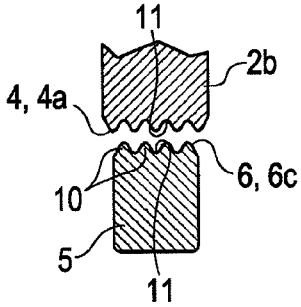 | 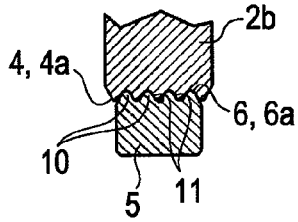 |

CARRIER RAPIER

BACKGROUND OF THE INVENTION

1. Field of the Invention

The present invention relates to carrier rapier used in a both-side rapier loom or in a one-side rapier loom.

2. Description of the Related Art

In general, weft insertion in a both-side rapier loom is performed with an insert rapier, provided at a yarn feeding side, and a carrier rapier, provided at a side opposite to the yarn feeding side. A weft, provided consecutively with a weft supply package, has an end thereof held by the insert rapier, and is conveyed to a weaving width center in a warp shed. At this position, the weft is received by the carrier rapier inserted in the shed from a side opposite to a weft insertion side, and is conveyed up to the side opposite to the weft insertion side of a cloth.

For example, as a structure of the carrier rapier in the both-side rapier loom, a structure in which a weft is naturally transferred by a movement relative to the insert rapier is available (refer to, for example, Japanese Unexamined Patent Application Publication No. 57-77353). A related carrier rapier of this type includes a carrier head, having a hook (what is called a turn-back portion in the application) provided at one end, and a moving wedge portion (what is called a catch lever in the application), disposed at an inner side of the hook so as to contact an inwardly facing surface of the hook. A wedge-shaped gap capable of holding a weft is formed between the inwardly facing surface of the hook (what is called a base surface in the application) and an opposing surface opposing the moving wedge portion.

In the carrier rapier, the hook and the moving wedge portion are such that the wedge-shaped gap becomes gradually and continuously smaller towards a tip of the carrier head, so that they eventually contact each other. Accordingly, a weft guiding portion that gradually widens from the wedge-shaped gap is formed at a side closer to a tip of the hook than the wedge-shaped gap. The moving wedge portion is biased so as to press the inwardly facing surface of the hook with, for example, a spring.

Near the weaving width center, when the carrier rapier receives the weft from the insert rapier, retreating of the carrier rapier relative to the insert rapier causes the wedge to be guided to the weft guiding portion (formed by the moving wedge-shaped portion and the inwardly facing surface of the hook of the carrier rapier) and to be held so as to be moved into a location (what is called a wedge holding portion in the application) in a gap capable of holding the weft. (Here, this type of wedge holding portion is called a negative weft holding device). In this way, after the weft is partly held at the location with which it contacts in the wedge-shaped gap in the carrier rapier, the weft is inserted to the side opposite to the weft insertion side by travelling of the carrier rapier.

In contrast, weft insertion in a one-side rapier loom is performed with a rapier head provided at a side opposite to a yarn feeding side. The rapier head is first conveyed in a direction opposite to a weft insertion direction in a warp shed. Then, the rapier head receives a laid weft at a position situated closer to a weft supply package than a weaving width, and is conveyed in an opposite direction (weft insertion direction) in the warp shed. In the application, not only the receiving side carrier rapier in the both-side rapier loom, but also such a rapier head provided at the side opposite to the yarn feeding side in the one-side rapier loom will hereunder be called a "carrier rapier."

However, there are a wide variety of types of wefts. In particular, when a weft whose portions have a low degree of alignment as a whole, such as a multi-filament yarn (formed of a plurality of filaments), a zero twist filament yarn (soft twisted filament yarn), or a an unsized yarn, is used, the portions of the weft diverge at a portion where the weft is held by the carrier rapier until the time the weft is inserted to a weaving end at the side opposite to the yarn feeding side by the carrier rapier (see FIG. 21).

Therefore, weft tension is concentrated at a portion that is adequately held by the weft holding portion (that is, a filament held at the contact portion where the gap is small) among the portions of the entire weft guided to the weft guiding portion. Therefore, for example, the weft is torn or the filament held at the back portion of the gap is broken or bent, thereby damaging the weft. As a result, the quality (related to the defects and texture of the weft) of a cloth is impaired.

The inventor of the application considers that the size of the gap formed by the base surface and the opposing surface and extending to the weft holding portion significantly affects the divergence of the portions of the weft. The following points will be described in detail.

In the related carrier rapier, when the wedge-shaped gap is seen from its side, the base surface and the opposing surface have linear shapes, have gently curved shapes, or have shapes that are a combination of these. For example, when the base surface and the opposing surface have gently curved shapes, the carrier rapier is formed so that its shape changes from a gently curved shape to a linear shape from a base end to a tip of the carrier rapier.

When both of the base surface and the opposing surface have linear shapes, an angle formed by the base surface and the opposing surface becomes constant (this angle is hereunder referred as "formation angle"). When at least one of the base surface and the opposing surface has a curved shape, the formation angle is gradually reduced towards the tip of the carrier rapier. Therefore, a formation angle at the weft guiding portion is a value that is at least greater than or equal to a formation angle at the weft holding portion.

The rate by which the size of a gap extending from the weft guiding portion to the weft holding portion is reduced is proportional to the formation angle. Therefore, the rate by which the size of the gap at the weft guiding portion is reduced is also gradually reduced in proportion to the formation angle.

A weft is guided to such a weft guiding portion and is held so as to be moved into the weft holding portion having a gap that has a size allowing the weft to be held. However, as seen from the weft holding portion, the gap at the weft guiding portion has a size that increases in proportion to the formation angle that is gradually increased. Therefore, when the weft reaches the weft holding portion, it cannot be said that the weft adequately contacts the base surface and the opposing surface at the weft guiding portion. In particular, when the portions of the weft have a low degree of alignment, the weft reaches the weft holding portion while its portions have a low degree of alignment.

The weft whose portions have a low degree of alignment is a weft that tends to be in a state in which a large number of spaces is formed between filaments constituting the weft as seen in cross section. When the weft in this state reaches the weft holding portion, the ratio of filaments that are inadequately held as a result of not being moved into the weft holding portion among the large number of filaments constituting the weft becomes large. In such a weft whose portions have a low degree of alignment, a holding force (that is, a friction force) acts upon only some of the filaments that are disposed at the gap at the weft holding portion and excessively moved into the weft holding portion. However, this holding force barely acts upon the filaments that are not adequately moved into the weft holding portion.

In addition, when the carrier rapier that has received the bulky weft travels towards the side opposite to the yarn feeding side, the weft tension is increased as a result of, for example, the weft contacting a shed warp. Therefore, the filaments upon which the holding force does not act (that is, the filaments that are not adequately moved into the weft holding portion) are pulled towards the yarn feeding side. As a result, the filaments of the weft at this portion diverge, thereby causing the weft to be torn in the worst case. Comparatively speaking, the tension of the entire weft concentrates on the filaments that are moved in excessively, thereby causing the filaments to be torn or bent at this portion. When the filaments are diverged once in this way, they are not aligned they were originally. When such a weft whose tension between the filaments is not uniform is woven, weaving detects, such as what is called a weft defect, occurs. As a result, the quality of a cloth is considerably deteriorated.

In order to prevent such defects from occurring, the formation angle may be reduced to make as small as possible the gap at the weft guiding portion, in particular, the gap near the weft holding portion. In this case, the base surface and the opposing surface need to be long so that the gap (opening) of the entrance of the weft guiding portion is a certain size. However, there is a limit as to how long they can be made because there is a limit as to how large the overall size of the carrier rapier can be made.

SUMMARY OF THE INVENTION

Accordingly, it is an object of the present invention to provide a carrier rapier whose tip has the shape of a hook and that can receive a weft by relatively moving the carrier rapier. In this carrier rapier, even if, for example, multi-filament yarns including a plurality of mono-filaments tend to diverge as a whole, and even if there is a limit as to how large the overall size of the carrier rapier can be made, the entire weft can be held while the filaments are aligned.

To this end, the invention of the application proposes the following. That is, in order to cause the weft to adequately contact the base surface and the opposing surface before the weft reaches the weft holding portion, an area of the weft holding portion whose size is close to that of the gap between the base surface and the opposing surface is provided between the weft guiding portion and the weft holding portion (that is, just before the weft holding portion), and the rate of change in the gap in the aforementioned area (that is, the rate of reduction in the formation angle) is less than the rate of change in the weft holding portion (that is, the rate of reduction in the formation angle).

More specifically, there is provided a carrier rapier used in a both-side rapier loom and whose tip is hook-shaped. The carrier rapier includes a weft guiding portion and a weft holding portion. The weft guiding portion is formed by a surface provided at a hook (hook-shaped portion) and an opposing surface opposing and contacting the surface provided at the hook. The weft holding portion has a wedge-shaped gap that can hold a weft. In the carrier rapier, a weft interfering portion adjacent to the weft holding portion including the wedge-shaped gap is provided between the weft holding portion and the weft guiding portion. Moreover, an angle (that is, a formation angle) formed by the two surfaces at an area of the weft interfering portion is less than a maximum value of the angle (that is, the formation angle) formed by the two surfaces at the area of the weft holding portion.

More specifically, according to the present invention, there is provided a carrier rapier (1) including a hook-shaped rapier head (2) having a base portion (2*f*) that extends to a tip (2*a*) of the rapier head (2) and a turn-back portion (2*b*) that is turned back from a side of the tip (2*a*) of the rapier head (2) towards a base end, a base surface (4) being formed at either of an inwardly facing surface (2*b*7) and a side surface (2*i*), formed consecutively with the inwardly facing surface (2*b*7), of the turn-back portion (2*b*); and a catch lever (5) having an opposing surface (6) opposing the base surface (4), the catch lever (5) biased in a direction in which the catch lever (5) presses the base surface (4) and being mounted to the rapier head (2). The base surface (4) and the opposing surface (6) form a weft holding portion (7*a*) and a weft guiding portion (9) that is disposed closer to a tip (2*c*) of the turn-back portion (2*b*) than the weft holding portion (7*a*). The weft holding portion (7*a*) is such that a gap provided between the base surface (4) and the opposing surface (6) becomes gradually smaller from a side of the tip (2*a*) of the turn-back portion (2*b*) towards the tip (2*a*) of the rapier head (2), and the weft holding portion (7*a*) is capable of holding a weft (3). The weft (3) provided from the side of the tip (2*c*) of the turn-back portion (2*b*) and through the weft guiding portion (9) is moved into and held by the weft holding portion (7*a*). The aforementioned structure is a presupposed structure. A distinctive feature of the invention is a weft interfering portion (8*a*) provided between the weft holding portion (7*a*) and the weft guiding portion (9), and having a predetermined length in a longitudinal direction of the carrier rapier. An angle formed by the base surface (4) and the opposing surface (6) at an area of the weft interfering portion (8*a*) is less than a maximum value of an angle formed by the base surface (4) and the opposing surface (6) at an area of the weft holding portion (8*a*).

Here, as seen from a side, an angle formed by the base surface (4) and the opposing surface (6) may be an angle formed by extension lines (tangent lines) of the two surfaces, or an angle formed by the two surfaces when one of the surfaces is imaginatively moved in parallel so that the one of the surfaces intersects with the other surface. For example, when the two surfaces are both linear surfaces, the angle formed by the two surfaces may be an angle formed by the extension lines of the two surfaces or an angle formed by the two surfaces when one of the surfaces is imaginatively moved in parallel so that the one of the surfaces intersects with the other surface.

This also applies when either one of the surfaces is a curved surface. When one of the surfaces is curved, and when the relationship between extension lines is used, the angle formed by the two surfaces may be an angle formed by a tangent line of the curved surface and an extension line of the linear surface. In addition, when both of the surfaces are curved, the angle formed by the two surfaces may be an angle formed by tangent lines of the two surfaces. When one of the two surfaces is curved, a plurality of tangent lines corresponding to positions in an extension direction exist, so that a plurality of the aforementioned angles formed by the two surfaces exist. In such a case, the relationship between the plurality of angles in this area will be discussed. This point also applies to the case in which the angle formed by the two surfaces is an angle formed when one of the surfaces is imaginatively moved in parallel.

In order to make it possible to use a plurality of wefts having different outside diameters, it is desirable to dispose two or more weft holding portions (7*a*, 7*b*, 7*c*) and weft interfering portions (8*a*, 8*b*, 8*c*) starting with that having a wide gap from the weft guiding portion (9) to the tip (2*a*) of the carrier rapier (1). It is possible for the weft holding portions to be provided in correspondence with the plurality of wefts having different outside diameters, and for the weft interfering portions to be provided for all of the wefts having different outside diameters or only a particular weft whose portions have a low degree of alignment.

More specifically, in order to correspond with wefts having a standard outside diameter and wefts (thin wefts) having outside diameters that are smaller than the standard outside diameter, by the base surface (4) and the opposing surface (6), a thin-weft interfering portion (8*b*) and a thin-weft holding portion (7*b*) are formed. The thin-weft interfering portion (8*b*) is formed closer to the tip (2*a*) of the carrier rapier than the weft holding portion (7*a*) and is formed continuously with the weft holding portion (7*a*). The thin-weft holding portion (7*b*) is formed closer to the tip (2*a*) of the carrier rapier than the thin-weft interfering portion (8*b*) and is formed continuously with the thin-weft interfering portion (8*b*). The thin-weft holding portion (7*b*) is provided so that a gap between the base surface (4) and the opposing surface (6) is gradually reduced and so that the thin-weft holding portion (7*b*) can hold a thin weft that is thinner than a weft held by the weft holding portion (7*a*). The thin-weft interfering portion (8*b*) is provided so as to be have a predetermined length in a longitudinal direction of the carrier rapier (1) and so that an angle formed by the base surface (4) and the opposing surface (6) at an area of the thin-weft interfering portion (8*b*) is less than the maximum value of the angle formed by the base surface and the opposing surface at the area of the thin-weft holding portion (7*b*).

Further, in order to make it possible to use wefts (thick wefts) having outside diameters that are greater than the standard outside diameter, a thick-weft holding portion (7*c*), formed continuously with the weft interfering portion (8*a*), is provided between the weft interfering portion (8*a*) and the weft guiding portion (9). The thick-weft holding portion (7*c*) is provided so that a gap formed between the base surface (4) and the opposing surface (6) is gradually increased towards a tip (2*c*) of a turn-back portion from the weft interfering portion (8*a*) and so that the thick-weft holding portion (7*c*) can hold a thick weft that is thicker than a weft that can be held by the weft holding portion (7*a*). Further, a thick-weft interfering portion (8*c*), formed continuously with the thick-weft holding portion (7*c*), is provided between the thick-weft holding portion (7*c*) and the weft guiding portion (9). The thick-weft interfering portion (8*c*) is provided so as to be have a predetermined length in the longitudinal direction of the carrier rapier (1) and so that an angle formed by the base surface (4) and the opposing surface (6) at an area of the thick-weft interfering portion (8*c*) is less than the maximum value of the angle formed by the base surface and the opposing surface at the area of the thick-weft holding portion (7*c*).

The predetermined length of at least one of the weft interfering portion (8*a*), the thin-weft interfering portion (8*b*), and the thick-weft interfering portion (8*c*) is desirably greater than or equal to 0.5 mm.

At least one of the base surface (4) and the opposing surface (6) at the weft interfering portion (8*a*) may be curved. In addition, it is possible for an angle formed by a tangential line of the one of the surfaces that is curved and a tangential line of the other surface that is linear or that is curved at the area of the weft interfering portion (8*a*) to be less than the maximum value of the angle formed by the base surface (4) and the opposing surface (6) at the area of the weft holding portion (7*a*). The term "weft interfering portion (8*a*)" may be read as "thin-weft interfering portion (8*b*)," and the term "weft holding portion (7*a*)" may be read as "thin-weft holding portion (7*b*)," to apply the present invention. In addition, the term "weft interfering portion (8*a*)" may be read as "thick-weft interfering portion (8*c*)," and the term "weft holding portion (7*a*)" may be read as "thick-weft holding portion (7*c*)."

Further, an angle formed by the base surface (4) and the opposing surface (6) within the area of the weft interfering portion (8*a*), the thin-weft interfering portion (8*b*), or the thick-weft interfering portion (8*c*) includes a negative value. The gap between the base surface (4) and the opposing surface (6) here is increased towards the tip (2*a*) of the carrier rapier.

However, an angle formed by the base surface (4) and the opposing surface (6) within the area of the weft interfering portion (8*a*) may be zero degrees. When it is zero degrees, the gap between the base surface (4) and the opposing surface (6) is provided in the area of the weft interfering portion (8*a*) so as to be the same as that at its entrance side at all times.

One or more protruding portions (10) may be provided at at least one of the catch lever (5) and the turn-back portion (2*b*) so as to extend from the weft holding portion (7*a*) to at least an interior of the area of the weft interfering portion (8*a*), the one or more protruding portions (10) protruding towards the other of the catch lever (5) and the turn-back portion (2*b*) in cross section that is perpendicular to a longitudinal direction of the carrier rapier (1). In addition, in place of the protruding portion or portions (10), one or more grooves (11) extending in the longitudinal direction of the carrier rapier (1) may be formed in at least one of the opposing surface (6) of the catch lever (5) and the base surface (4) at the turn-back portion (2*b*), and the one or more grooves (11) may be made to extend from the weft holding portion (7*a*) to at least the area of the weft interfering portion (8*a*). Here, specific forms of the extending protruding portion (10) (groove (11)) include a form in which the protruding portion (10) extends to a portion of the area of the weft interfering portion (8*a*) and a form in which the protruding portion (10) extends along the entire area of the weft interfering portion (8*a*) (also including a form in which the protruding portion (10) extends beyond the weft interfering portion (8*a*) and towards the tip (2*c*) of the turn-back portion. In one example, in order to make it possible to use a plurality of yarn types having different outside diameters, when the thin-weft interfering portion (8*b*) and the thin-weft holding portion (7*b*) are provided closer to the tip (2*a*) of the carrier rapier than the weft holding portion, the protruding portion (10) (groove (11)) is provided so as to extend from the weft holding portion (7*a*) into at least the area of the thin-weft holding portion (7*b*).

The maximum value of the angle formed by the base surface (4) and the opposing surface (6) in the area of each of the weft holding portion (7*a*), the thin-weft holding portion (7*b*), and the thick-weft holding portion may be from at least 2° to 10° at most.

The rapier head (2) of the carrier rapier (1) according to the invention of the application is a single member excluding the catch lever (5). Alternatively, the rapier head (2) may be one in which a member having a mounting portion for mounting to a rapier band (that is, a rapier body 1*a* described below) and a tip member forming a hook portion at the tip (a carrier head 2' described below) are connected and integrated to each other.

In what is called the hook carrier rapier (1), the weft interfering portion (8*a*) is provided between the weft guiding portion (9) and the weft holding portion (7*a*), provided at a gap that can hold the weft, so as to have a predetermined length in the longitudinal direction of the carrier rapier and so as to be formed continuously with them. The angle formed by the base surface (4) and the opposing surface (6) within the area of the weft interfering portion (8*a*) is less than the maximum value of the angle formed by the base surface (4) and the opposing surface (6) at the area of the weft holding portion (7*a*), so that the rate of change of the gap between the base surface (4) and the opposing surface (6) at the weft interfering portion (8*a*) when viewed from the side of the weft holding portion (7*a*) is small. Therefore, it is possible to guide the weft to the weft holding portion (7*a*) through the area of the weft interfering portion (8*a*) having the gap that is less than that in the related art.

The weft (3) can adequately contact the base surface (4) and the opposing surface (6) at the weft interfering portion (8*a*) and pass therebetween. That is, since the weft (3) advances between the base surface (4) and the opposing surface (6) at the weft interfering portion (8*a*) while the entire weft contacts them, even if the weft (3) is of a type whose portions have a low degree of alignment, that is, of a type that is bulky with large gaps (spaces) being formed between filaments, the spaces between the filaments are gradually narrowed when the weft (3) passes the weft interfering portion (8*a*), so that the filaments of the weft (3) are gradually aligned. When the overall shape of the weft (3) is viewed, the weft (3) that somewhat bulges as a whole in the bulky state is slightly crushed as a whole while being radially compressed as a result of moving along the weft interfering portion (8*a*). The weft (3) that is kept in this shape is moved to the weft holding portion (7*a*), and is held so as to be moved into the wedge-shaped groove of the weft holding portion (7*a*).

Accordingly, since, while the weft (3) is kept aligned as a whole, the weft (3) is radially compressed and slightly crushed as a whole, and moves to the weft holding portion (7*a*), the proportion of the weft filaments upon which friction force of the base surface (4) and the opposing surface (6) at the weft holding portion (7*a*) acts is larger than that in related carrier rapiers.

Further, since the weft (3) passes the weft interfering portion (8*a*) and reaches the weft holding portion (7*a*) while the weft (3) is kept in the slightly crushed state as a whole, the amount by which the weft (3) is moved into the wedge-shaped gap at the weft holding portion (7*a*) can be larger than those in related carrier rapiers. More specifically, since, in the moved-in state, a contact length of the weft (3) that contacts the base surface (4) and the opposing surface (6) is greater than those in related carrier rapiers, a larger friction force, that is, a larger weft holding force can be obtained. In this way, the proportion of the filaments upon which the friction force acts is increased due to the compression of the weft (3). This synergistically increases the weft holding force, so that the weft can be stably held as a whole.

Accordingly, even if the weft (3) is a weft whose portions have a low degree of alignment as a whole and tend to diverge as a whole, such as a multi-filament yarn (formed of a plurality of mono-filaments), the entire weft can be stably held. Even if the weft tension is instantaneously increased until weft insertion is completed after the weft is received from an insert rapier, it is possible to prevent damage to the weft (3) occurring in related carrier rapiers, such as the filaments of the weft (3) diverging from each other, the weft (3) being torn, or the filaments being bent or broken at locations where a curve is sharp. Therefore, a good cloth having few detects, such as a weft defect, caused by damaging the weft can be efficiently produced.

The angle formed by the base surface (4) and the opposing surface (6) within the area of the weft interfering portion (8*a*), the thin-weft interfering portion (8*b*), or the thick-weft interfering portion (8*c*), that is, the formation angle may be zero degrees. Alternatively, the gaps extending from the weft interfering portions (8*a*, 8*b*, 8*c*) to the respective weft holding portions (7*a*, 7*b*, 7*c*) and corresponding to the wefts (3) having the respective outside diameters can be provided so that they do not widen by setting the formation angles to positive values that are less than the maximum values of the angles at the respective weft holding portions (7*a*, 7*b*, 7*c*). This makes it possible to move the wefts (3) to the respective weft holding portions (7*a*, 7*b*, 7*c*) while keeping the wefts (3) compressed by the weft interfering portions (8*a*, 8*b*, 8*c*). Therefore, the entire wefts (3) can be held.

However, in the entire areas of the weft interfering portions (8*a*, 8*b*, 8*c*), the base surface (4) and the opposing surface (6) may be formed so that the sizes of the gaps between the base surface (4) and the opposing surface (6) are reduced (that is, so that the angles between the base surface (4) and the opposing surface (6), that is, the formation angles are negative values that are less than zero degrees. In this case, the gaps at the entrance sides of the weft interfering portions (8*a*, 8*b*, 8*c*) may have sizes that allow contact with and passage of the wefts (3). In this embodiment, when the wefts (3) pass the weft interfering portions (8*a*, 8*b*, 8*c*) having small gaps, the wefts (3) that bulge as wholes are radially compressed, so that they are further crushed as wholes, and can move towards the weft holding portions (7*a*, 7*b*, 7*c*). Therefore, compared to the embodiments in which the aforementioned gaps do not widen (that is, the angles at the weft interfering portions, that is, the formation angles are zero degrees or positive values), the amounts by which the wefts (3) are compressed are increased, so that they are moved into the weft holding portions (7*a*, 7*b*, 7*c*) by larger amounts. Therefore, a higher weft holding force can be obtained than in related carrier rapiers. Consequently, the divergence of weft filaments caused by the traveling of the carrier rapier can be prevented from occurring, so that the entire wefts can be stably held.

In addition, when the angles formed by the base surface (4) and the opposing surface (6) at the weft interfering portions (8*a*, 8*b*, 8*c*), that is, the formation angles are zero degrees, the wefts (3) having a low degree of alignment as wholes can be moved to the weft holding portions (7*a*, 7*b*, 7*c*) while being kept compressed as wholes when they pass the weft interfering portions (8*a*, 8*b*, 8*c*). Therefore, even if the wefts (3) have portions having a very low degree of alignment, the entire wefts can be held. The aforementioned angles are not limited to zero degrees. The angles may be positive or negative values that are close to zero degrees, more specifically, less than +2° to at least −2°.

One or more protruding portions (10) (grooves (11)) extending in the longitudinal direction of the carrier rapier (1) are formed in at least one of the opposing surface (6) of the catch lever (5) and the base surface (4) at the turn-back portion (2*b*), and the one or more protruding portions (10) (grooves (11)) extend from the weft holding portion (7*a*) to at least the area of the weft interfering portion (8*a*) or the thin-weft holding portion (7*b*). Therefore, when the weft (3) is held, the one or more protruding portions (10) (grooves (11)) at the weft holding portion (7*a*) or the thin-weft holding portion (7*b*) pull in the weft (3), so that the weft holding force at the weft holding portion (7*a*) and that at the thin-weft holding portion (7*b*) are increased in correspondence with the fact that a contact area can be increased.

Since two or more weft holding portions (7*a*, 7*b*, 7*c*) and weft interfering portions (8*a*, 8*b*, 8*c*) whose gaps have different intervals are disposed starting with that having a wide gap from the weft guiding portion (9) to the tip (2*a*) of the carrier rapier (1), one carrier rapier can be used for wefts (3) having different thicknesses, and can perform multi-color weft insertion using a plurality of wefts (3) having different outside diameters and whose portions are not aligned as wholes.

BRIEF DESCRIPTION OF THE DRAWINGS

FIGS. 19A to 19C are sectional views of other practical forms of a base surface and an opposing surface opposing the base surface, and each shows a cross section along X-X of a weft interfering portion shown in FIG. 5 and a cross section along Y-Y of a contact portion, the cross sections being placed side by side;

DESCRIPTION OF THE PREFERRED EMBODIMENTS

Figure 1:
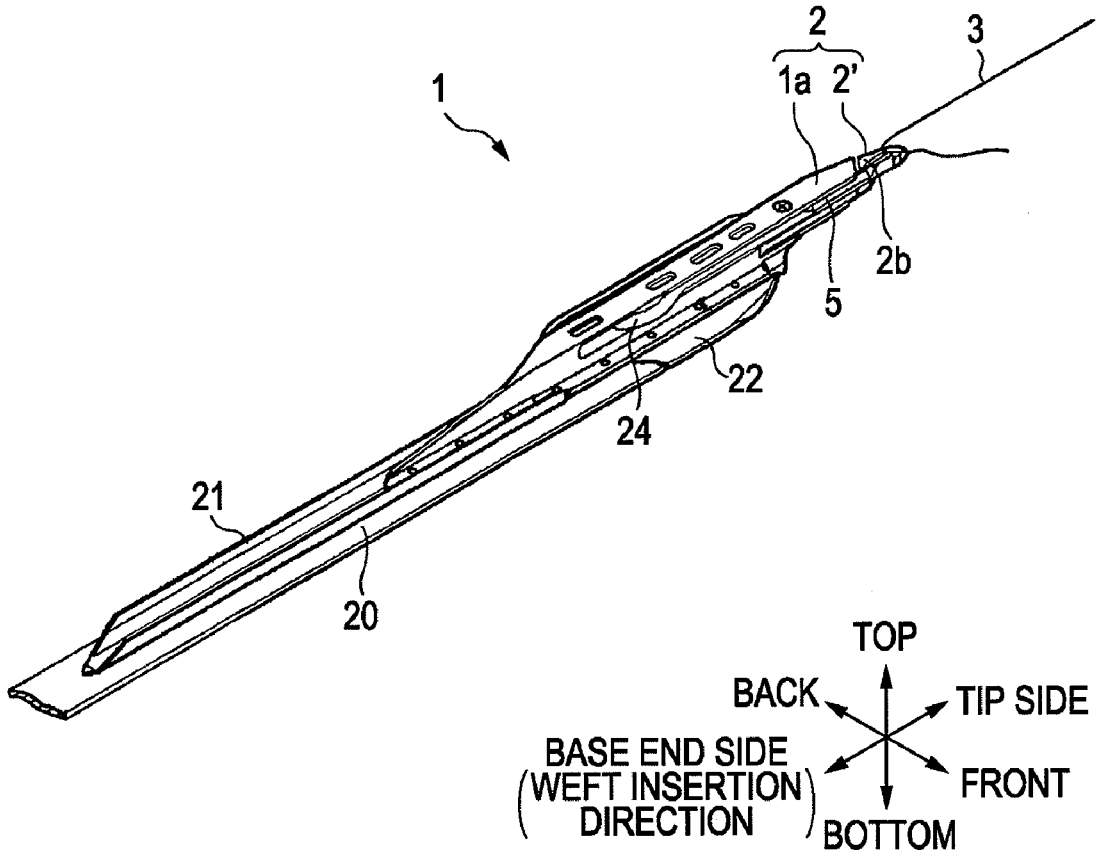
FIG. 1 is a perspective view of an entire carrier rapier according to an embodiment of the present invention.
Figure 2:
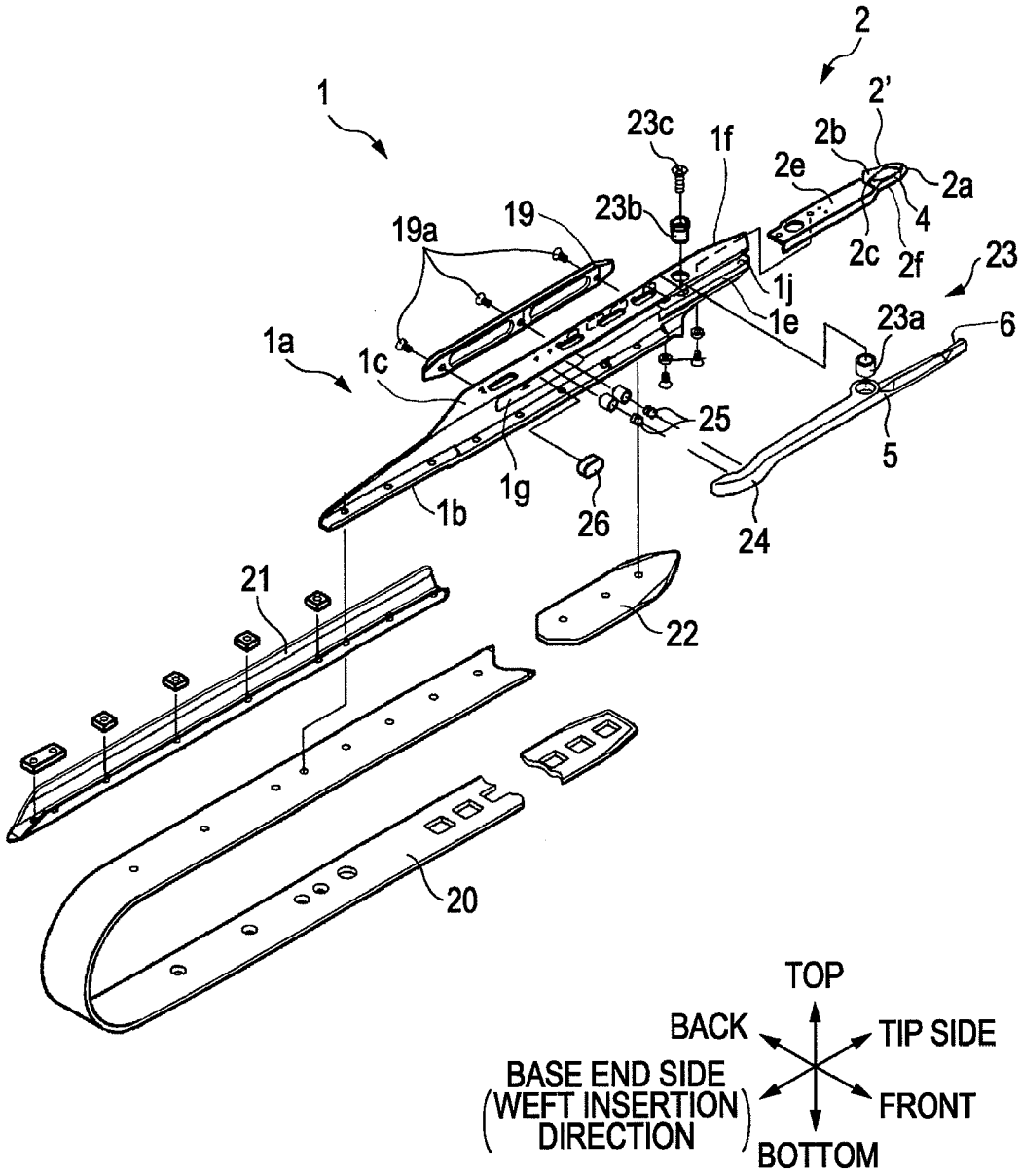
FIG. 2 is a perspective view showing the shape of each member constituting the carrier rapier shown in FIG. 1.
Figure 3:
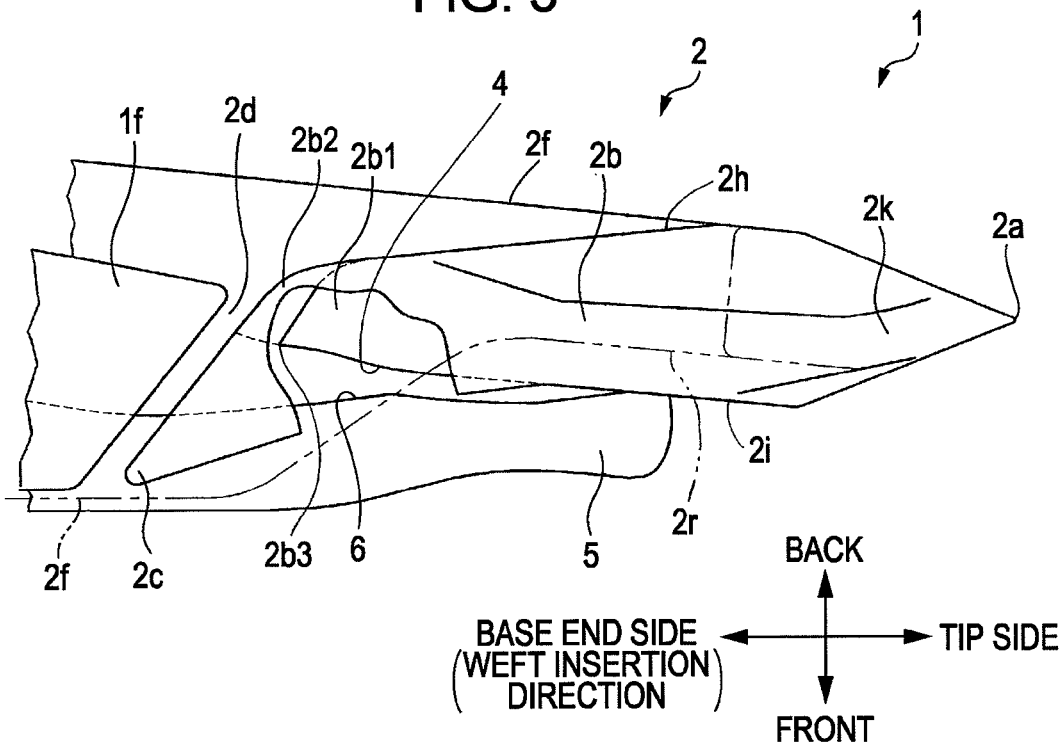
FIG. 3 is an enlarged partially cutaway plan view of a hook portion and the vicinity thereof in the carrier rapier shown in FIG. 1.
Figure 4:
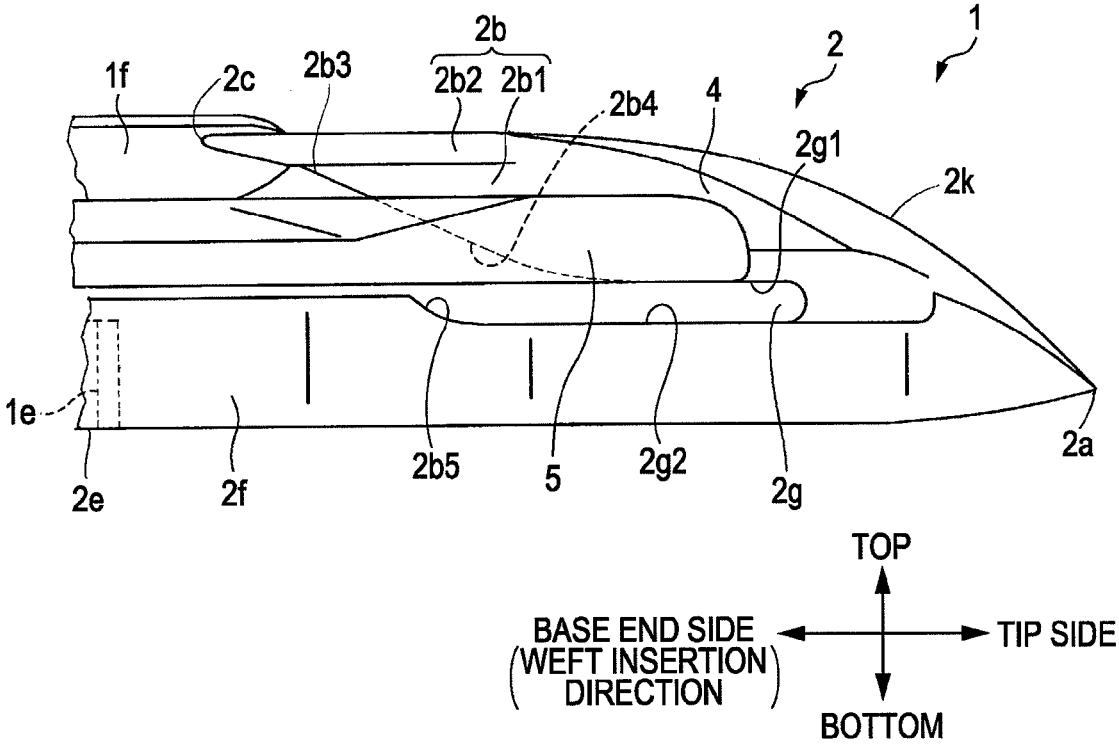
FIG. 4 is an enlarged side view of the hook portion and the vicinity thereof in the carrier rapier shown in FIG. 1.
Figure 5:
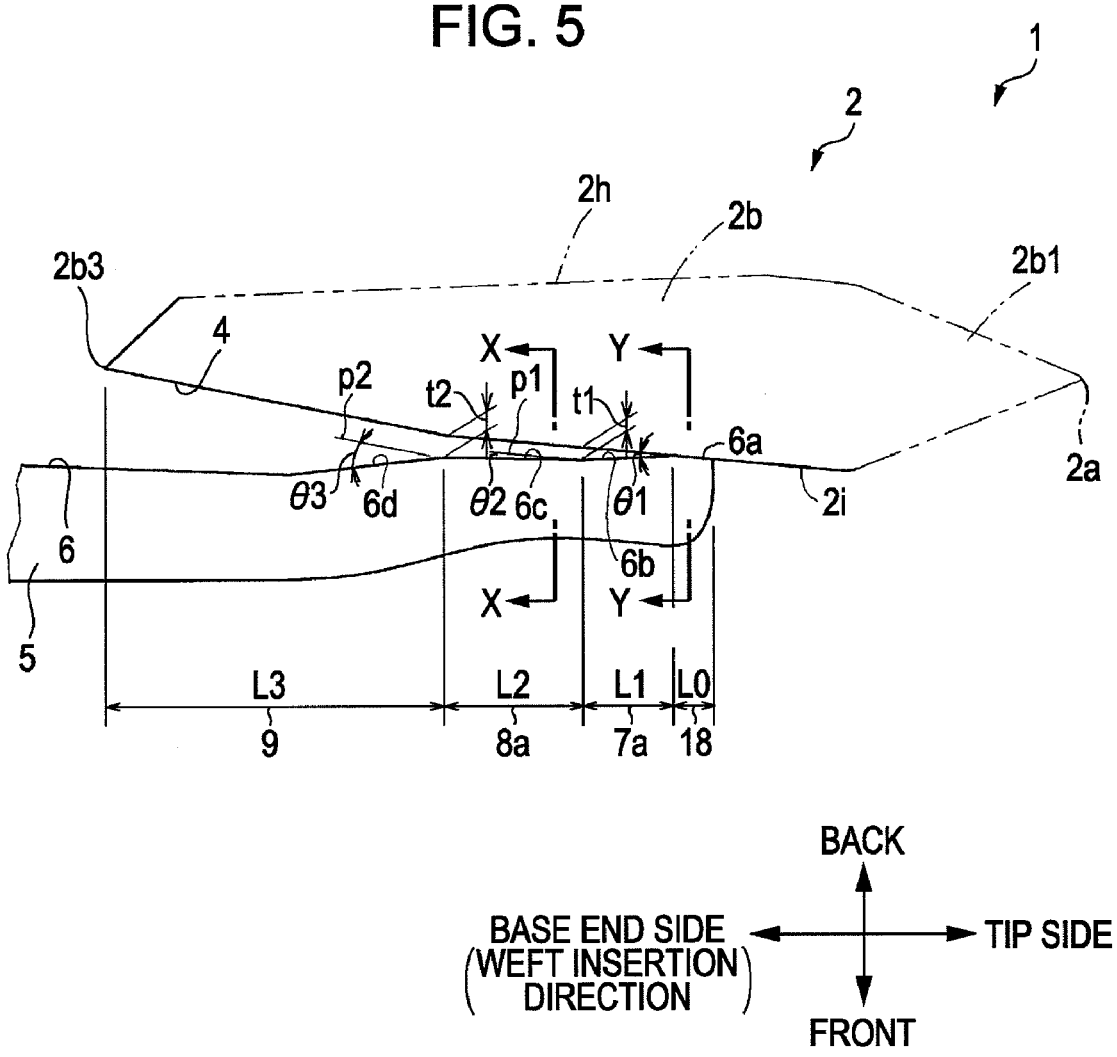
FIG. 5 is an enlarged view of an embodiment (first embodiment) of a weft holding portion of the carrier rapier shown in FIG. 1, and shows in enlarged form a base surface and an opposing surface opposing the base surface, which are main portions.

FIGS. 1 to 5 show a carrier rapier according to an embodiment to which the present is applied. Here, in the application, for the sake of simplifying the description, the front and back directions, a tip, a base end, and the upward and downward directions of the carrier rapier will be defined on the basis of the directions indicated in the figures. A carrier rapier 1 shown in FIGS. 3 and 5 is seen from a side of a weft holding portion 7*a* with the tip of a rapier head 2 facing rightwards and a base surface 4 at the weft holding portion 7*a* being above an opposing surface 6 of a catch lever 5.

The carrier rapier according to the present invention is used in a both-side rapier loom. The carrier rapier 1, whose tip is hook-shaped, is inserted into a warp shed from a side opposite to a weft insertion side; crosses an insert rapier (not shown) that is inserted into the shed from the weft-insertion side near substantially the center of a weaving width; retreats towards the side opposite to the weft insertion side in the shed while receiving a weft 3 from the insert rapier as the carrier rapier 1 retreats; and conveys the weft 3 up to a fabric cloth end at the side opposite to the weft insertion side. The weft 3 is held by moving the weft 3 into a wedge-shaped gap (the weft holding portion 7*a* described later) when the carrier rapier 1 moves relative to the insert rapier. The gap is formed by a turn-back portion of the carrier rapier 1 and the catch lever 5 that contacts the turn-back portion. That is, the carrier rapier 1 according to the present invention presupposes a carrier rapier including a negative weft holding device that can receive the weft 3 from the insert rapier without positively opening the catch lever 5.

A general description of the carrier rapier 1 will be given with reference to FIGS. 1 and 2. The carrier rapier 1 includes a rapier body 1*a*, a carrier head 2' whose tip is hook-shaped, and the catch lever 5 as main members. The carrier rapier 1 is mounted to a tip of a rapier band 20 through a mounting member 21. A head chip 22 is mounted to the lower surface of the rapier body 1*a*. The head chip 22 is a member that slides along a rail of a loom body (not shown) when the carrier rapier 1 reciprocates, and is formed of a material having low friction resistance.

As shown in FIG. 2, the upper surface at the base end of the longitudinally extending rapier body 1*a* is substantially flat. A mounting portion 1*b* that is mounted to the rapier band 20 is formed at the base-end side lower surface of the rapier body 1*a*. In addition, a mounting portion 1*c* that is mounted to a slide guide 19 is formed at a back-side side end portion of the rapier body 1*a*, and the slide guide 19 is mounted to the mounting portion 1*c* with screws 19*a*. A rectangular groove 1*g* opening towards the front is provided at a front-side side end portion of the rapier body 1*a* so as to extend towards a tip 2*a*. The rapier body 1*a* is C-shaped in cross section. At an area situated closer to the tip than the mounting portion 1*c*, the groove 1*g* of the rapier body 1*a* extends through the back-side side end portion from the front-side side end portion so as to open towards the tip. An upper wall portion 1*f* and a mounting seat 1*e* are integrally formed with the rapier body 1*a* so as to extend towards the tip from an end portion of the groove 1*g* with a space 1*j* being disposed between the upper wall portion 1*f* and the mounting seat 1*e*.

As shown in FIGS. 2 to 4, in the carrier head 2', a base portion 2*f* extending to the tip 2*a* from a mounting portion 2*e*, a turn-back portion 2*b* turned back above the base portion 2*f* and extending towards the base end are integrated to the mounting portion 2*e*; and, as shown in FIG. 4, a penetrating space 2*g* extending in the front-back direction (that is, sideways) is formed between the base portion 2*f* and the turn-back portion 2*b*. As shown in FIG. 2, such a carrier head 2' is such that its mounting portion 2*e* (which opens downward and is C-shaped in cross section) is fitted to the mounting seat 1*e* at the rapier body 1*a*; and is integrally mounted to the rapier body 1*a* with screws (not shown). The carrier head 2' and the rapier body 1*a* constitute the rapier head 2 of the carrier rapier 1. An accommodating portion that can receive the catch lever 5 (described later) is formed in the front-side side end portion of the carrier rapier 1 by the groove 1*g* and the space 1*j* continuously formed with the groove 1*g*. In addition, a hook portion in which the base portion 2*f* is a hook base and a tip 2*c* at the turn-back portion 2*b* is a hook tip is formed at a location situated closer to the tip than the accommodating portion. In addition to the rapier head 2 being formed by joining the carrier head 2' and the rapier body 1*a* as in the embodiment, the rapier head 2 may be formed by integrating the carrier head 2' and the rapier body 1*a* to each other.

The catch lever 5 is accommodated in the groove 1*g* (which is substantially C-shaped in cross section) of the aforementioned rapier body 1*a*; and is rotatably mounted to the rapier body 1*a* with shaft members 23 (a bush 23*a*, a pin 23*b*, and a screw 23*c* shown in FIG. 2) that are vertically inserted. In FIG. 3, the substantially flat base surface 4 is formed at a front-side side portion 2*i* of the turn-back portion 2*b* at the rapier body 1*a*. With the carrier lever 5 being mounted to the rapier body 1*a*, the opposing surface 6 opposing the base surface 4 is formed at a tip-side side portion of the catch lever 5. As shown in FIG. 2, a pressure receiving portion 24 is provided at an end portion of the carrier lever 5 at a side opposite to the opposing surface 6 with a rotational center (shaft member 23) being disposed therebetween.

A compression spring 25, serving as a biasing member, is interposed between the pressure receiving portion 24 and the rapier body 1*a*. The compression spring 25 is received by a spring holder (not shown) disposed at the groove 1*g*, and biases the catch lever 5 in a direction in which it causes the pressure receiving portion 24 to protrude. By this, the carrier head 2' and the catch lever 5 are in contact with each other at a contact portion 18 (described later) at the tip side of the carrier rapier 1. A shock-absorbing member 26 (cushion) is disposed between the pressure receiving portion 24 and the bottom portion at the groove 1*g*. The pressure receiving portion 24 of the catch lever 5 is capable of contacting an opener cam (not shown), disposed closer to a side opposite to a yarn feeding side than a cloth, when the carrier rapier is traveling.

The weft holding device (that is, a form of the rapier head 2) of the carrier rapier 1 will be described with reference to FIGS. 3 and 4 in which the vicinities thereof are enlarged. The base portion 2*f* of the rapier head 2 is such that a side end portion 2*r* is formed in such a way as to be compressed in a widthwise direction so that the front-side side portion approaches the back-side side surface 2*h* in an area extending from the mounting portion 2*e* towards the tip. Then, while maintaining its width, the base portion 2*f* is such that the side end portion 2*r* is joined with the turn-back portion 2*b*. Then, at a location situated closer to the tip, the base portion 2*f* is such as to taper in the widthwise direction and the vertical direction (that is, is such as to be formed like a point of a double edge), and the base portion 2*f* reaches the tip 2*a*.

The turn-back portion 2*b* of the rapier head 2 has a base section 2*b*1 as a main portion. The front-side side surface 2*i* (that is, the base surface 4) with which the catch lever 5 (described later) contacts and an upwardly facing guiding surface 2*k* that gradually extends upward from the tip 2*a* towards the base end are formed at the base section 2*b*1. The base section 2*b*1 is provided so as to converge towards the tip 2*a* in the vertical direction and the widthwise direction (front-back direction). That is, from the tip 2*a* towards the base end, the upwardly facing guiding surface 2*k* first extends gradually upward and then maintains its height so that it is substantially the same as that of the upper surface of the upper wall portion 1*f* of the rapier body 1*a*. The base section 2*b*1 is provided so as to protrude forwardly from the front-side side end portion 2*r* in an area in which the base portion 2*f* is compressed in the widthwise direction. The front-side side surface 2*i* extending with a substantially flat shape in the up-down direction and the longitudinal direction is formed as the base surface 4.

Further, at the base section 2*b*1 of the turn-back portion 2*b*, a blade-shaped portion 2*b*2 extending in the form of a plate in the front-back direction (widthwise direction) extends closer to the base end than a base 2*b*3. An upwardly facing guiding surface of the blade-shaped portion 2*b*2 is formed continuously with the upwardly facing guiding surface 2*k* of the base section 2*b*1. In addition, as shown in FIG. 3, similarly to an end surface of the upper wall portion 1*f*, a base-end-side end surface of the blade-shaped portion 2*b*2 extends obliquely in the longitudinal direction, and reaches the tip 2*c*. A slit 2*d* through which a weft can pass is formed between the blade-shaped portion 2*b*2 and a front end surface of the upper wall portion 1*f* of the rapier body 1*a*. A guiding surface 2*b*4 (called an inwardly facing surface in the application) is formed at the base section 2*b*1. The guiding surface 2*b*4 has the base 2*b*3 as its starting point and gradually extends downwards towards a downwardly facing surface 2*g*1 defining a space 2*g*. Along with a guiding surface 2*b*5 formed continuously with an upwardly facing surface 2*g*2 defining the space 2*g*, the guiding surface 2*b*4 forms a path that communicates with the slit 2*d*.

Accordingly, when the carrier rapier 1 enters a warp shed, even if any warp having a shed defect exists, the warp having the shed defect and guided to the upper side of the tip 2*a* is caused to continuously contact the upwardly facing guiding surface 2*k* and the upper wall portion 1*f* of the rapier body 1*a* of the carrier rapier 1, so that any warp that can be guided to the upper side is pushed aside, thereby preventing the warp having the shed defect from being caught by the carrier rapier 1. The slit 2*d* is formed so as to extend obliquely without a predetermined angle with respect to the longitudinal direction (traveling direction). When the carrier rapier 1 receives a weft 3 from the insert rapier (not shown), only the weft 3 placed in a tensioned state along the upper wall portion 1*f* of the insert rapier without a predetermined angle being formed with respect to a weft insertion direction is capable of passing through the slit 2*d*, and is capable of moving into the space 2*g* in the turn-back portion 2*b* through the downwardly facing guiding surface 2*b*4. The width of the slit 2*d* is determined in accordance with the thickness of the weft 3 that is used. However, the width of the slit can be adjusted within a certain range by changing the mounting position in the longitudinal direction of the carrier head 2' with respect to the mounting seat 1*e* of the rapier body 1*a*. The rapier body 1*a* and the carrier head 2' may be formed as an integral member by cutting a single member.

The weft holding device of the carrier rapier 1, which is a main portion in the present invention, will hereunder be described in detail with reference to FIG. 5, which is an enlarged view of a main portion of the weft holding device as viewed in cross section along the direction of extension of the base surface 4 (the opposing surface 6), that is, an enlarged view of the main portion of the weft holding device as seen from a side thereof.

A weft holding device of the carrier rapier 1 according to a first embodiment holds a weft 3 by moving the weft 3 into a portion between the base surface 4 and the opposing surface 6 of the catch lever 5 that contacts the base surface 4. The front-side side surface 2*i* of the turn-back portion 2*b* (base section 2*b*1) of the rapier head 2 is defined as the base surface 4. The weft holding device is such that the manner in which the gaps between the two surfaces gradually change gradually varies up to the contact portion. More specifically, the weft holding device is one in which the angles formed by the two surfaces (that is, the base surface 4 and the opposing surface 6) forming the gaps gradually change as viewed in the longitudinal direction. In the first embodiment shown in FIG. 5, the weft holding device has a structure in which the base surface 4 (front-side side surface) at the turn-back portion is flat; whereas, viewing the opposing surface 6 of the catch lever 5 that opposes the base surface 4 in cross section, the catch lever 5 is provided with a plurality of flat segment surfaces (opposing surfaces 6*a* to 6*d*), so that angles θ3, θ2, and θ1 formed by the two surfaces as viewed in the longitudinal direction gradually change.

More specifically, as shown in FIG. 5, as viewed from above the carrier rapier 1, the base surface 4 (provided at the front-side side surface 2*i* of the turn-back portion 2*b* of the rapier head 2) and the opposing surface 6 (6*a* to 6*d*) of the catch lever 5 form a weft guiding portion 9, the weft holding portion 7*a*, and the contact portion 18 from the base end side of the carrier rapier 1 in the longitudinal direction of the carrier rapier 1. A weft interfering portion 8*a*, which is a distinctive feature of the present invention, is formed between the weft guiding portion 9 and the weft holding portion 7*a*. In FIG. 5, for the sake of simplifying the description, only the portion of the turn-back portion 2*b* (base section 2*b*1) where the base surface is provided and the tip of the catch lever 5 are shown by solid lines, and the blade-shaped portion 2*b*2, the turn-back portion 2*b*, and the base portion 1*f* of the rapier body 1*a* are not shown. The sizes of the gaps at the sections between the base surface 4 and the opposing surface 6 (the segment surfaces 6*a* to 6*d* as viewed in cross section) may be somewhat wider without departing from the gist of the present invention.

It goes without saying that the contact portion 18 is an area where the opposing surface 6*a* of the catch lever 5 contacts the base surface 4 at the turn-back portion 2*b*. At the contact portion 18, there is almost no gap between the two surfaces, so that a weft 3 is not allowed to pass between the opposing surface 6*a* and the base surface 4.

The weft holding portion 7*a* that is adjacent to the base-end side of the contact portion 18 is formed by the base surface 4 and the opposing surface 6*b*. From the base end to the tip of the carrier rapier 1, the base surface 4 and the opposing surface 6*b* form a wedge-shaped space by providing the gap so that its size gradually decreases or so that it allows a weft to be held. A distance L1 in the longitudinal direction of the weft holding portion 7*a*, an interval t1 of the gap between the base surface 4 and the opposing surface 6*b* at an entrance portion of the weft holding portion 7*a* (that is, the portion of the weft holding portion 7*a* closest to the base end), and the angle θ1 formed by the base surface 4 and the opposing surface 6 at the weft holding portion 7*a* are determined by the type of weft 3 to be held. For example, the distance L1 may be from 1.0 mm to 6.0 mm, the interval t1 of the entrance portion may be from 0.1 mm to 2.0 mm, and the angle θ1 formed by the base surface 4 and the opposing surface 6*b* at this section may be from at least 2° to 10° at most. In general, when the interval t1 is viewed with the diameter of the weft 3 as a viewing location, if the outside diameter of a mono-filament of the weft 3 is d, and the outside diameter of the entire weft 3 that is bulged as a whole is D, it is possible for the interval t1 to satisfy the condition $d<t1 \leqq 4/5*D$.

The weft guiding portion 9 having the base 2*b*3 as its starting point is formed by the base surface 4 and the opposing surface 6*d*. The portions of the base surface 4 and the opposing surface 6*d* at the weft guiding portion 9 are formed so that the gap between these surfaces gradually decrease towards the tip, and so as to be formed continuously with the portions of the base surface 4 and the opposing surface 6*c* at the weft interfering portion 8*a* (described later). By these two surfaces, the weft 3 inserted from the weft insertion slit 2*d* is guided towards the weft interfering portion 8*a*. The angle θ3 formed by the base surface 4 and the opposing surface at this area (that is, the angle formed by the opposing surface 6*d* and an imaginary line p2 formed by imaginatively moving the base surface 4 in parallel) is greater than the angle θ1 at the weft holding portion 7*a*. For example, a distance L3 in the longitudinal direction of the weft guiding portion 9 is set in the range of from 5.0 mm to 10.0 mm. Near the base 2*b*3, the weft 3 may be reliably inserted if the gap between the base surface 4 and the opposing surface 6*d* at this area does not hinder the guiding of the weft (for example, the gap may have a size that is at least twice the outside diameter D of the weft 3).

The weft interfering portion 8*a* (provided between the weft guiding portion 9 and the weft holding portion 7*a*) is formed by the base surface 4 and the opposing surface 6*c*. Both sides of the opposing surface 6*c* are formed continuously with opposing surfaces 6*d* and 6*b* that are adjacent to the opposing surface 6*c*. Moreover, the opposing surface 6*c* is formed so that the angle θ2 formed by the base surface 4 and the opposing surface 6*c* (that is, the angle formed by the opposing surface 6*c* and an imaginary line p1 formed by imaginatively moving the base surface 4 in parallel) is less than the angle θ1 formed by the base surface 4 and the opposing surface 6*b* at the area of the weft holding portion 7*a*. Therefore, since the gap at the weft holding portion 7*a* adjacent to the weft interfering portion 8*a* is capable of holding a weft and the angle θ2 formed by the two surfaces at the weft interfering portion 8*a* is less than the angle θ1 formed at the adjacent weft holding portion 7*a*, the gap formed by the two surfaces at the weft interfering portion 8*a* contacts the whole weft 3 while allowing the weft 3 to move.

The weft interfering portion 8*a* is provided over the distance L2 in the longitudinal direction of the carrier rapier 1. The weft interfering portion 8*a* is formed as a space whose slope changes more gently than the wedge-shaped space at the weft holding portion 7*a* and the guide space at the weft guiding portion 9 and that extends substantially parallel to the longitudinal direction of the carrier rapier 1. The weft interfering portion 8*a* reduces divergence of filaments of the weft 3 when the weft 3 is inserted, and guides the weft 3 to the wedge-shaped gap at the weft holding portion 7*a*. The distance L2 in the longitudinal direction of the weft interfering portion 8*a* may be, for example, greater than the outside diameter d of the mono-filament of the weft 3. The distance L2 may actually be in the range of from 0.5 mm to 6.0 mm. The distance L2 is actually restricted by design (the length of the turn-back portion 2*b* of the rapier head 2). This point similarly applies to the distance L3 of the weft guiding portion 9.

Figure 6A:
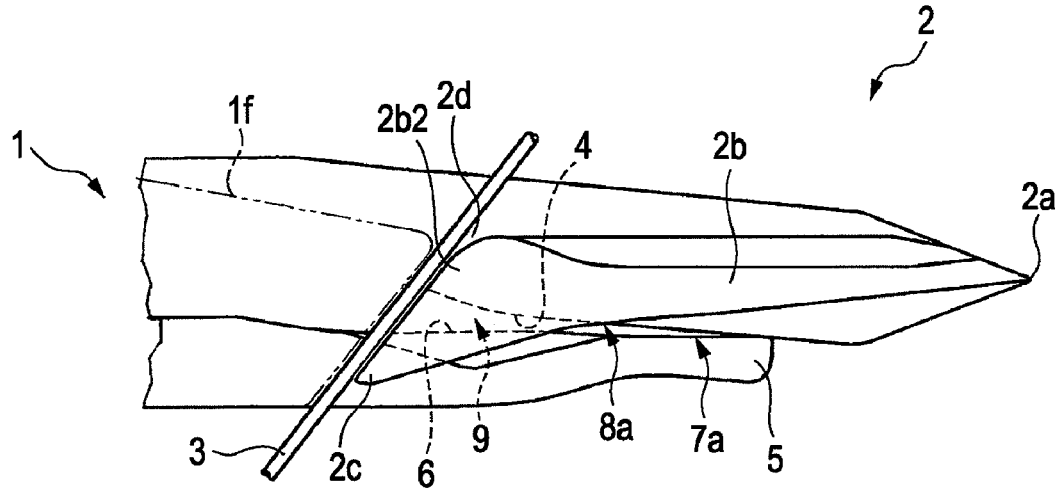
FIGS. 6A and 6B are, respectively, an enlarged plan view and an enlarged side view of a state in which the weft holding portion of the carrier rapier shown in FIG. 1 holds a weft.
Figure 6B:
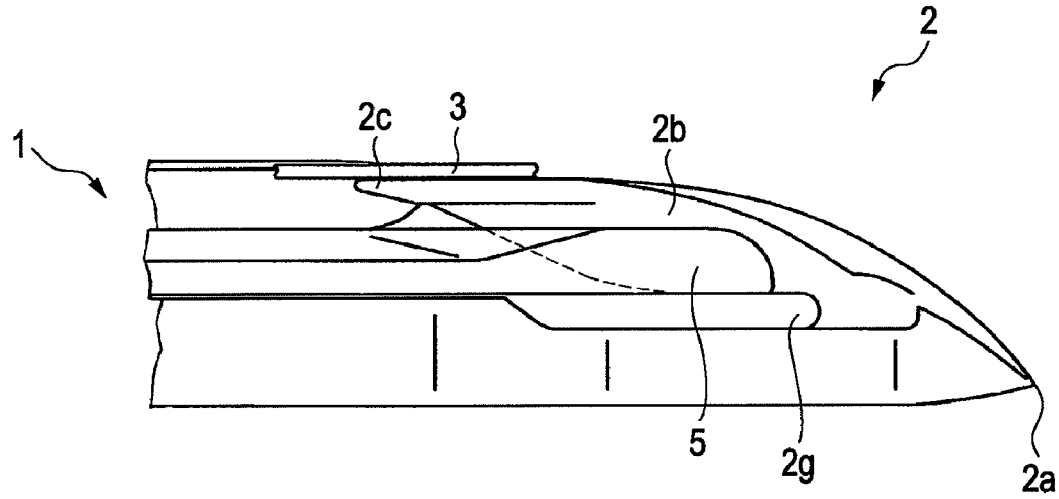
Figure 7A:
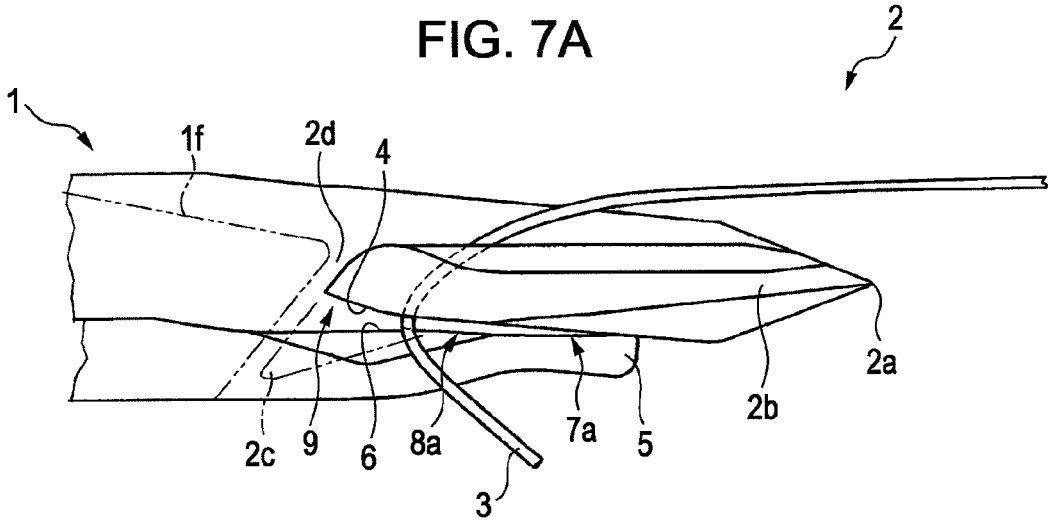
FIGS. 7A and 7B are, respectively, an enlarged plan view and an enlarged side view of a state in which the weft holding portion of the carrier rapier shown in FIG. 1 holds the weft.
Figure 7B:
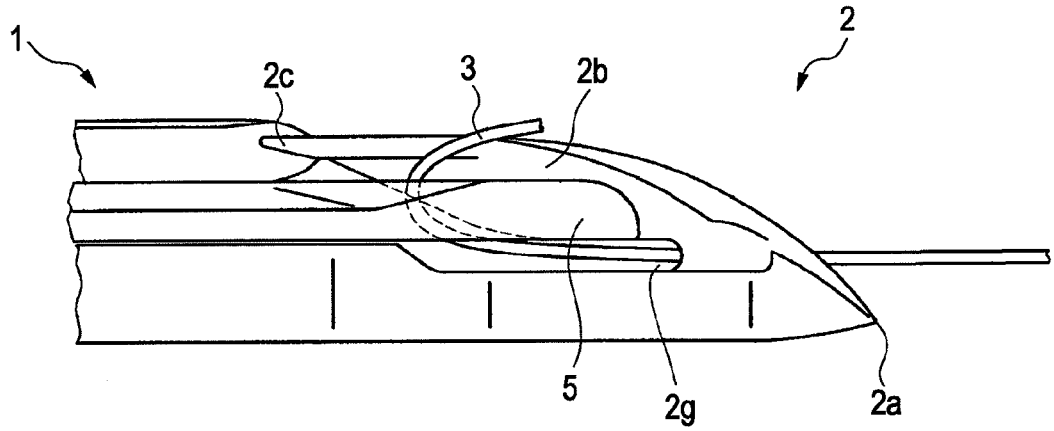
Figure 8A:
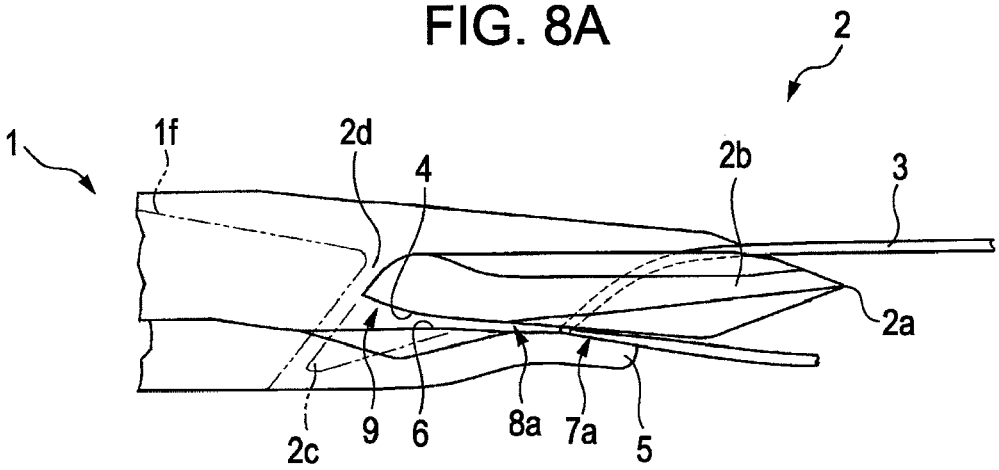
FIGS. 8A and 8B are, respectively, an enlarged plan view and an enlarged side view of a state in which the weft holding portion of the carrier rapier shown in FIG. 1 holds the weft.
Figure 8B:
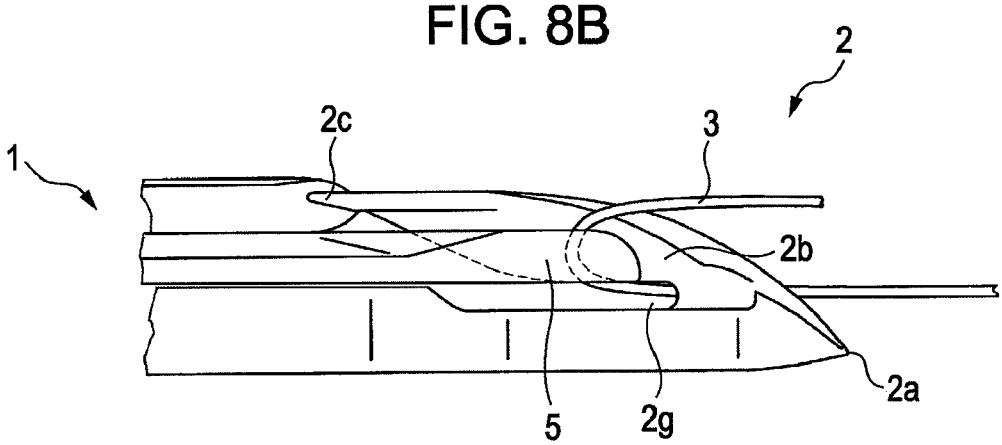

FIGS. 6A to 8B each show a state in which the carrier rapier 1 according to the present invention holds a weft 3. For the sake of simplifying the description, the blade-shaped portion 2*b*2 of the turn-back portion 2*b* of the rapier head 2 is not shown in FIGS. 7A and 8A. In FIGS. 6A and 6B, an end of the weft 3 is held by the insert rapier (not shown). The weft 3 provided along the upper wall portion 1*f* of the carrier rapier 1 at a predetermined angle with respect to the weft insertion direction passes through the weft insertion slit 2*d* and enters the inside passage. Then, by relative movement of the weft 3 as a result of retreating of the carrier rapier 1, as shown in FIGS. 7A and 7B, the weft 3 is guided to the weft guiding portion 9 and reaches the weft interfering portion 8*a*. By this, the weft 3 at a weft supply package is inserted into the inside space 2*g* at the turn-back portion 2*b*. Then, when the carrier rapier 1 retreats further, the weft 3 relatively moves towards the tip of the rapier head 2 while contacting the base surface 4 and the opposing surface 6 at the weft interfering portion 8*a*. At this time, the weft 3 is gradually compressed in the radial direction, and is formed into a slightly crushed shape as a whole. Thereafter, the weft 3 having the slightly crushed shape moves towards the weft holding portion 7*a*, and, as shown in FIGS. 8A and 8B, is moved into and held by the wedge-shaped gap at the location that matches the thickness of the weft 3.

Accordingly, the angle formed by the base surface 4 and the opposing surface 6 at the area of the weft interfering portion 8*a* is less than a maximum value of the angle formed by the base surface 4 and the opposing surface 6 at the area of the weft holding portion 7*a*, so that, as viewed from the weft holding portion 7*a*, the rate of change in the gap between the opposing surface 6 and the base surface 4 at the weft interfering portion 8 is reduced. Therefore, at the gap between the base surface 4 and the opposing surface 6 at the weft interfering portion 8*a*, an area where the size of the gap is close to that of the gap at the weft holding portion 7*a* is longer than that in a related carrier rapier.

The weft 3 can adequately contact the base surface 4 and the opposing surface 6 at the weft interfering portion 8*a*, and pass therebetween. That is, the whole weft 3 passes through the gap, having whose size that is greater than that at the weft holding portion 7*a* (that is, a size that allows the weft to be held), between the base surface 4 and the opposing surface 6 at the weft interfering portion 8*a* while contacting the base surface 4 and the opposing surface 6. Therefore, even if the portions of the weft 3 have a low degree of alignment, that is, even if the weft 3 is of a bulky type in which the gaps (spaces) between the filaments are large, the spaces between the filaments are gradually narrowed, so that the filaments of the weft 3 are gradually aligned. When the overall shape of the weft 3 is viewed, the weft 3 that somewhat bulges as a whole in the bulky state is slightly crushed as a whole while being radially compressed gradually as a result of moving along the weft interfering portion 8*a*. The weft 3 that is kept in this shape is moved to the weft holding portion 7*a*, and is held so as to be moved into the wedge-shaped groove of the weft holding portion 7*a*.

Accordingly, since, while the portions of the weft 3 are aligned as a whole, the weft 3 is radially compressed and slightly crushed as a whole, and moves to the weft holding portion 7*a*, the proportion of the weft filaments upon which friction force of the base surface 4 and the opposing surface 6 at the weft holding portion 7*a* acts is larger than that in related carrier rapiers. Further, since the weft 3 passes the weft interfering portion 8*a* and reaches the weft holding portion 7*a* while the weft 3 is kept in the slightly crushed state as a whole, the amount by which the weft 3 is moved into the wedge-shaped gap at the weft holding portion 7*a* can be larger than those in related carrier rapiers. More specifically, since, in the moved-in state, a contact length of the weft 3 that contacts the base surface 4 and the opposing surface 6 is greater than those in related carrier rapiers, a larger friction force, that is, a larger weft holding force can be obtained. In this way, the proportion of the filaments upon which the friction force acts is increased due to the compression of the weft 3. This synergistically increases the weft holding force, so that the weft can be stably held as a whole.

At a timing that is substantially the same as that at which the weft is held by the carrier rapier 1, the weft is ungripped from the insert rapier (not shown). Then, the carrier rapier 1 retreats in a warp shed in the weft insertion direction, and moves out from the warp shed. At a timing in which the carrier rapier 1 moves out from the warp shed, an opener cam (not shown), provided at the frame of the loom body, presses the pressure receiving portion 24 at the catch lever 5 (shown in FIG. 1), and the catch lever 5 rotates in a direction in which the opposing surface 6 thereof moves away from the base surface 4. As a result, the weft 3 is freed from the carrier rapier 1, is subjected to beating, and becomes a cloth.

According to the carrier rapier 1 of the present invention, even if, as in the related arts, the weft 3 is a weft whose portions have a low degree of alignment and tend to diverge as a whole, such as a multi-filament yarn (formed of a plurality of mono-filaments), the entire weft 3 can be stably held. Even if the weft tension is instantaneously increased until weft insertion is completed after the weft 3 is received from the insert rapier, it is possible to prevent damage to the weft 3 occurring in related carrier rapiers, such as the filaments of the weft 3 held by the weft holding portion 7*a* diverging from each other, the weft 3 being torn, or the filaments being bent or torn at locations where a curve is sharp. Therefore, a good cloth having few detects, such as a weft defect, caused by damaging the weft can be efficiently produced.

Here, the inventor et al. of the present application have performed the following comparisons and examinations by comparing the proportion of the weft filaments upon which friction force acts at a weft holding portion 7*a* in a product of the invention of the application with that of a related product. Unsized and untwisted multi-filament yarns were used for wefts. The angle θ1 formed at the weft holding portion 7*a* in each of the products of the invention of the application and related products was +5°. In the product of the invention of the application, a weft interfering portion 8*a* having a length on the order of 0.5 mm was provided, and the angle θ2 formed at the weft interfering portion 8*a* was +1°. The other conditions, such as the overall size of the carrier rapier, the relative movement speed of the weft, and the weft tension, were substantially the same.

The proportions of the filaments upon which the weft holding force acts were confirmed by the amount by which the filaments were removed when a tension larger than a maximum instantaneous tension acted upon during weaving after the weft was held by the carrier rapier. The confirmation showed that, while the proportion of the filaments upon which the holding force acted in the related product was less than 30%, the proportion of the filaments upon which the holding force acted in the product of the present invention of the application was 80% or more.

Further, the product of the invention of the application having the above-described form was mounted to a loom, and a trial weaving operation in which a weft of the same yarn type as that used in the comparison and the examination was actually inserted was performed. It was confirmed that damage to the weft, such as divergence of the filaments at a location where the weft was held by the carrier rapier, did not occur. A cloth obtained by the test weaving was inspected.

The inspection showed that the occurrence of defects, such as a weft defect, occurring in the related carrier rapier was considerably reduced.

The weft holding device according to the first embodiment may be modified as follows. The sign of the angle θ2 formed by the two surfaces at the weft interfering portion 8*a* is not questioned as long as it is less than θ1. More specifically, it is possible to set the angle θ2 at zero degrees, and form the weft interfering portion 8*a* as a completely parallel space. The angles θ1 to θ3 defined in the application are defined as angles when viewed from a side of the weft holding portion 7*a* with the tip 2*a* of the carrier rapier 1 facing rightwards and the base surface 4 at the weft holding portion 7*a* being positioned above the opposing surface 6 of the catch lever 5. A positive angle in the application means that the gap in the form shown in FIG. 5, that is, the gap between the base surface 4 and the opposing surface 6 becomes gradually smaller from the base end side to the tip 2*a* of the carrier rapier 1. In contrast, a negative angle means that the gap becomes gradually larger (tapers in the opposite direction) from the base end side to the tip 2*a* of the carrier rapier 1.

An interval t2 of the gap between the base surface 4 and the opposing surface 6*c* at the weft interfering portion 8*a* is set to a value that is the same as or close to a maximum value (t1) of the gap at the weft holding portion 7*a*. However, when the interval of the gap increases or decreases in each area, a minimum value t2min of the gap at the corresponding area may be a value greater than or equal to that allowing passage of the entire weft 3, and a maximum value t2max of the corresponding gap may be a value allowing the whole weft 3 to contact the base surface 4 and the opposing surface 6*c*.

The base surface 4 and the opposing surface 6 in the first embodiment are both flat surfaces, that is, are each formed by combining a plurality of flat segment surfaces as viewed from the top of the carrier rapier 1. However, as described later, the base surface 4 and the opposing surface 6 may each be formed of a curved surface having a large radius of curvature and a flat surface formed continuously with the curved surface (refer to FIGS. 9 to 11).

Figure 9:
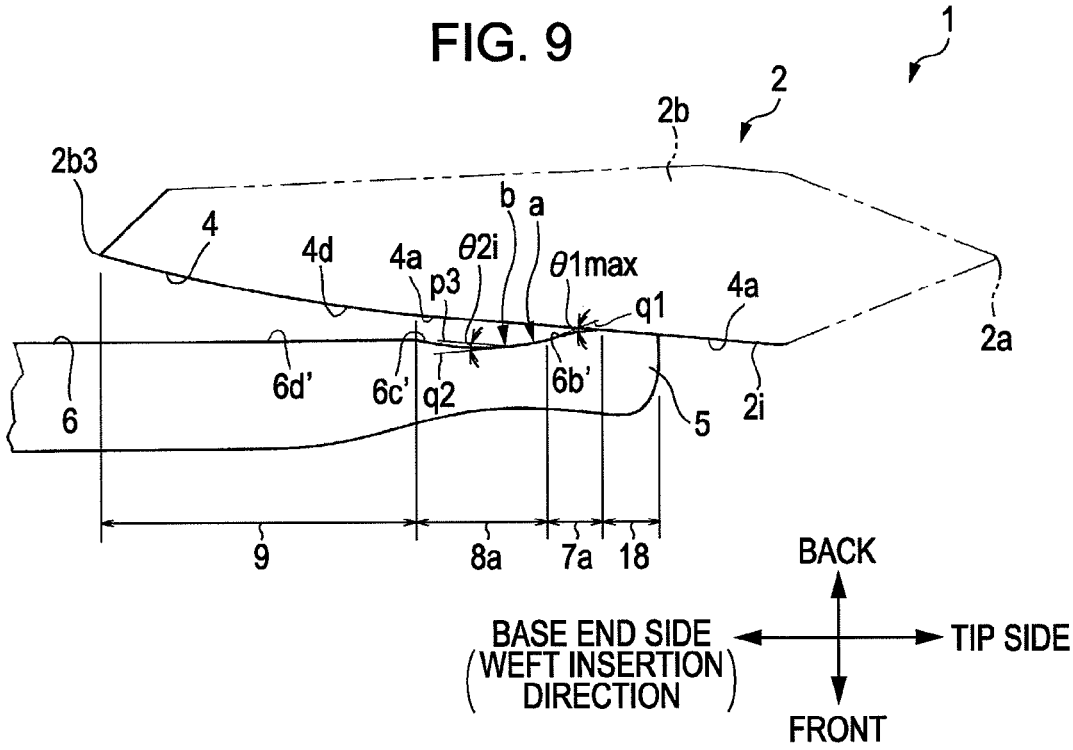
FIG. 9 is an enlarged view of a modification of the weft holding portion of the carrier rapier according to the present invention.

FIG. 9 shows an exemplary structure in which the base surface 4 and the opposing surface 6 are each formed by combining a flat surface and a curved surface having a large radius of curvature. In the exemplary structure, a base surface 4*a* at the areas of the weft holding portion 7*a* and the weft interfering portion 8*a* is a flat surface, and a base surface 4*d* at the area of the weft guiding portion 9 is a downwardly protruding curved surface. The opposing surface 6 of the catch lever 5 is such that an opposing surface 6*b*' at the area of the weft holding portion 7*a* is formed of an upwardly protruding curved surface, an opposing surface 6*c*' at the area of the weft interfering portion 8*a* is formed of a downwardly protruding curved surface, and an opposing surface 6*d*' at the area of the weft guiding portion 9 is formed as a flat surface.

As with FIG. 5, in FIG. 9, for the sake of simplifying the description, for example, the interval between the base surface 4 and the opposing surface 6 (opposing surfaces 6*b*' to 6*d*') and the curvature of the curved surface of the opposing surface 6 (opposing surfaces 6*b*' and 6*c*') are somewhat exaggerated without departing from the gist of the present invention. In FIG. 9, as a representative example of an angle formed by the two surfaces at the weft holding portion 7*a*, an angle θ1max formed by the base surface 4 and a tangential line q1 at the opposing surface at a point (shown by an alphabet "a") near the weft interfering portion 8*a* is shown. In addition, in FIG. 9, as a representative example of an angle formed by the two surfaces at the weft interfering portion 8*a*, an angle θ2*i* formed at an intermediate point (shown by an alphabet "b") by a tangential line q2 at the opposing surface and an imaginary line p3 formed by imaginatively moving the base surface 4 in parallel is shown.

As in the embodiment shown in FIG. 5, when the base surface 4 of the rapier head 2 and the opposing surface 6 of the catch lever 5 are both formed of a combination of linearly extending flat surfaces as seen from a side thereof, the angles θ1 and θ2 formed by the base surface 4 and the opposing surface 6 are each set to one value in the areas that extend linearly. However, when, as in this exemplary structure, at least one of the base surface 4 and the opposing surface 6 is a curved surface, that is, when, as viewed from a side of the rapier head 2, at least one of the base surface 4 and the opposing surface 6 has curved portions, the angle θ1 and the angle θ2 formed by the two surfaces vary in the longitudinal direction of the carrier rapier 1 in the areas including the respective curved portions, so that they are not one value. In such a case, the maximum angle θ1max in the area of the weft holding portion 7*a* is read as θ1. Actually, since the weft holding portion 7*a* is wedge-shaped, at the entrance portion of the weft holding portion 7*a* (corresponding to the portion of the weft holding portion 7*a* situated closest to the base end, that is, the point indicated by the alphabet "a"), the angle formed by the base surface 4 (the tangential line at the base surface 4) and the opposing surface 6 (the tangential line at the opposing surface 6) is the maximum angle θ1max, that is, θ1.

In this case, in any of the points in the area of the weft interfering portion 8*a*, the base surface 4 and the opposing surface 6 may be formed so that an angle θ2*i* (i=1 . . . n; i is a variable provided to each point; and n is a positive integer) formed by the base surface 4 (the tangential line at the base surface 4) and the opposing surface 6 (the tangential line at the opposing surface 6) is less than the maximum angle θ1 (=θ1max) at the weft holding portion 7*a*. Accordingly, even if the weft holding portion 7*a* and the weft interfering portion 8*a* both have curved surfaces, as in the first embodiment, a weft whose portions tend to diverge can be stably held. Moreover, the contact length of the base surface 4 and the opposing surface 6 with respect to the weft 3 can be longer than the case in which linear surfaces are formed, so that an operating force (that is, a holding force) can be increased.

Figure 10:
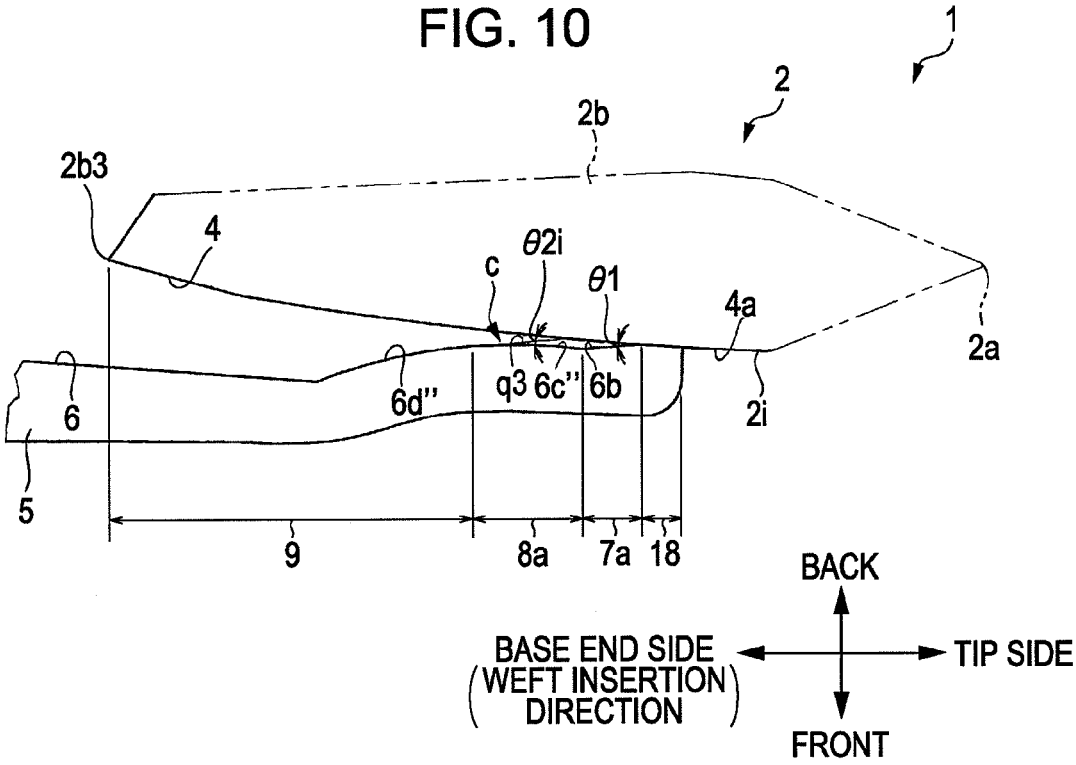
FIG. 10 is an enlarged view of another modification of the weft holding portion of the carrier rapier according to the present invention.

FIGS. 10 to 13 show other exemplary shapes of the base surface 4 and the opposing surface 6. FIG. 10 shows an exemplary shape in which both the base surface 4 and the opposing surface 6 have protruding curved surfaces at the weft interfering portion 8*a* and the weft guiding portion 9. More specifically, the base surface 4 has an arched-shaped surface having a large radius of curvature and extending continuously from the weft holding portion 7*a* to the weft guiding portion 9, and the opposing surface 6 has arch-shaped surfaces 6*c*" and 6*d*" having smaller curvature radii than the base surface and extending continuously from the weft interfering portion 8*a* to the weft guiding portion 9. As a representative example of an angle formed by the two surfaces at the weft interfering portion 8*a*, an angle θ2*i* formed at an intermediate point indicated by an alphabet c by the base surface 4 and a tangential line q3 at the opposing surface is shown.

Figure 11:
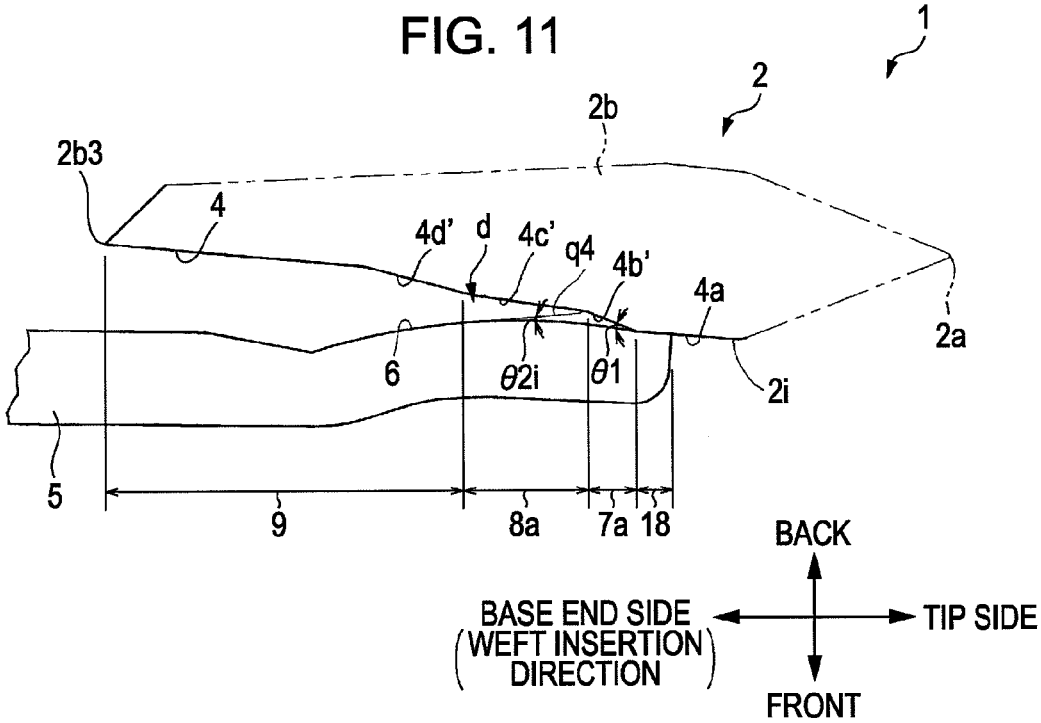
FIG. 11 is an enlarged view of still another modification of the weft holding portion of the carrier rapier according to the present invention.

FIG. 11 shows an exemplary shape in which the base surface 4 is formed of a combination of flat surfaces, and the opposing surface 6 has a protruding curved surface. More specifically, the opposing surface 6 has an arch-shaped surface having a large radius of curvature and extending continuously from the weft holding portion 7*a* to the weft guiding portion 9, and the base surface 4 has flat segment surfaces 4*b*', 4*c*', and 4*d*' whose angles gradually change. As a representative example of an angle formed by the two surfaces at the weft interfering portion 8*a*, an angle θ2*i* formed at an intermediate point indicated by an alphabet "d" by the base surface 4 and a tangential line q4 at the opposing surface is shown.

Figure 12:
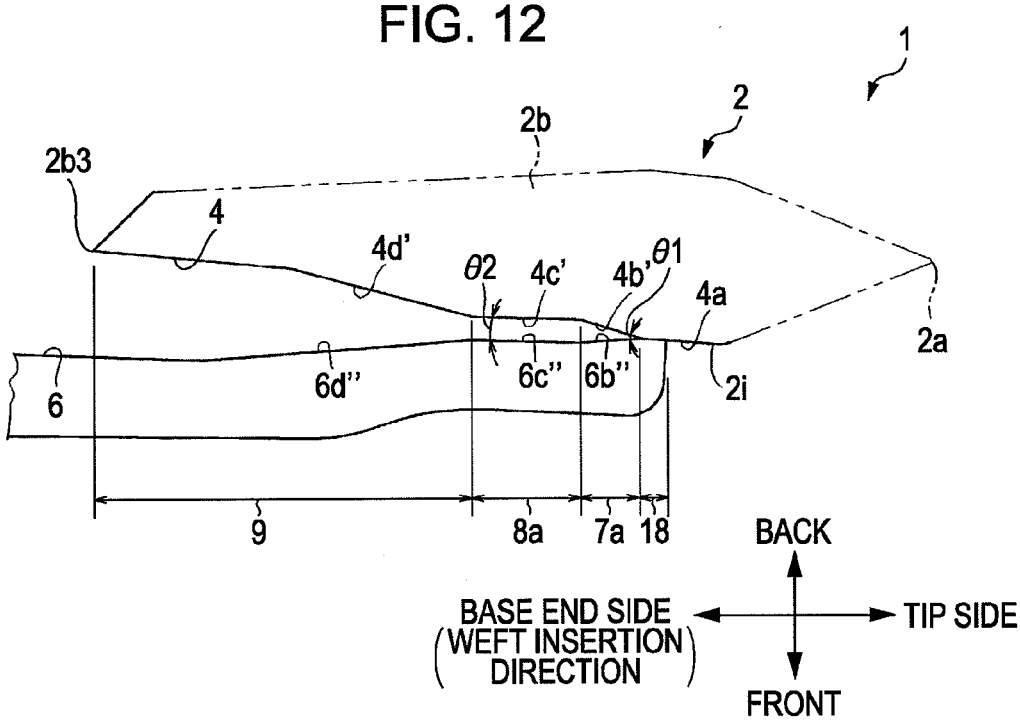
FIG. 12 is an enlarged view of still another modification of the weft holding portion of the carrier rapier according to the present invention.

Further, FIG. 12 shows an exemplary shape in which the base surface 4 and the opposing surface 6 are both formed of a combination of flat segment surfaces at the respective areas, that is, the base surface 4 has base segment surfaces 4*b*', 4*c*', and 4*d*', and the opposing surface 6 has opposing segment surfaces 6*h*", 6*c*", and 6*d*". In addition, the exemplary shape is one in which an angle θ2 formed by the base surface 4*c*' and the opposing surface 6*c*" at the weft interfering portion 8*a* (that is, an angle at which the base surface 4*c*' and the opposing surface 6*c*" are substantially parallel to each other) is zero degrees. For the sake of simplifying the illustration, the angle θ2 at the weft interfering portion 8*a* is showed in a simplified manner without, for example, imaginary lines. The angle θ2 at the weft interfering portion 8*a* may also be positive or negative values that are close to zero degrees in addition to being zero degrees.

In FIGS. 10 to 12 mentioned above, in accordance with the gist of the present invention, the base surface 4*c*' and the opposing surface 6*c*" is provided so that the angles θ2, θ2*i* (i=1 . . . n; n is a positive integer) formed at the weft interfering portion 8*a* is a positive value that is less than the angle θ1 (=θ1max) formed at the weft holding portion 7*a* or a value that is close to zero degrees. In other words, by providing the gap so that it does not widen from the weft interfering portion 8*a* to the weft holding portion 7*a*, the weft can be moved to the weft holding portion 7*a* while maintaining the compressed state of the weft 3 compressed by the weft interfering portion 8*a*, thereby making it possible to hold the whole weft 3.

More desirably, as shown in FIG. 12, by setting the angle formed by the base surface 4*c*' and the opposing surface 6*c*" at the weft interfering portion 8*a*, that is, the formation angle to a positive value or a negative value close to zero degrees or to zero degrees, a weft whose portions have a low degree of alignment as a whole can move along the weft holding portion 7*a* while the weft maintains its compressed state as a whole when passing to the weft interfering portion 8*a*. Therefore, even if the portions of the weft have a low degree of alignment as a whole, the weft can be held as a whole, so that it is possible to prevent, for example, filaments of the weft from diverging when the carrier rapier is operating. A positive value or a negative value close to zero degrees may be in the range of from, for example, less than +2° to at least −2°.

Figure 13:
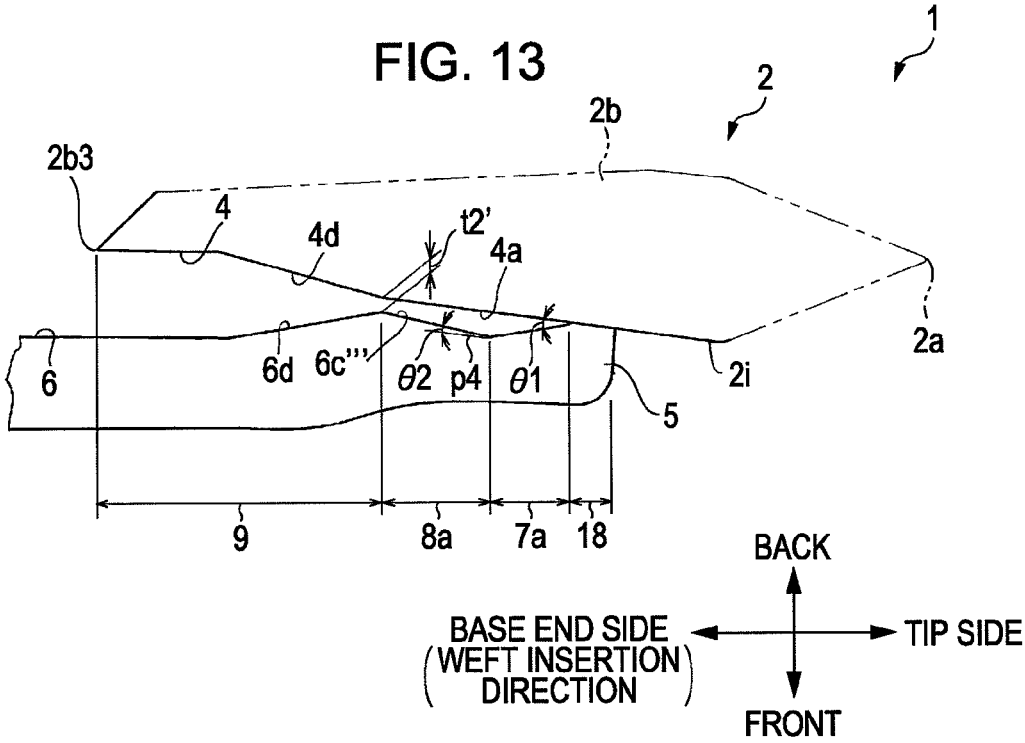
FIG. 13 is an enlarged view of still another modification of the weft holding portion of the carrier rapier according to the present invention.

As shown in FIG. 13, the opposing surface 6*c*''' may be provided so that the angles θ2 and θ2*i* at the weft interfering portion 8*a* is a negative value that is less than zero degrees (more specifically, −5°). An interval t2' at the entrance side of the weft interfering portion 8*a* may be a value allowing the weft to contact the weft interfering portion 8*a* as a whole and pass along the weft interfering portion 8*a*. In such an example, by passing the weft along a smallest section of a gap at the weft interfering portion 8*a*, the weft 3 is compressed as described above. Then, when the weft 3 moves to a portion of the gap that is wider than the smallest section, the compressed weft may be somewhat restored to its original shape, and may return to its original bulky state. However, the time taken for the weft 3 to move from the weft interfering portion 8*a* to the weft holding portion 7*a* is very short. The reduction in the amount by which the weft 3 is moved in when the weft 3 is restored to its original shape is essentially slight. Therefore, it is possible for the weft 3 to be somewhat crushed as a whole while its portions are aligned even at the weft interfering portion 8*a*, and to move to the weft holding portion 7*a*. Therefore, compared to the exemplary shapes shown in FIGS. 10 to 12 in which the gaps do not widen (that is, the angle formed at the weft interfering portion 8*a*, that is, the formation angle is zero degrees or a positive value), although the weft holding force is slightly reduced, a weft holding force that is higher than that in related carrier rapiers is obtained. Consequently, it is possible to prevent the filaments of the weft from diverging when the carrier rapier operates, and to stably hold the whole weft. In FIG. 13, as a representative example of an angle formed by the two surfaces at the weft interfering portion 8*a*, the angle θ2 formed by the opposing surface 6*c*''' at the weft interfering portion 8*a* and an imaginary line p4 formed by imaginatively moving the base surface 4*a* in parallel is shown. Since the opposing surface 6*c*''' is situated beyond the imaginary line p4 as seen from a side, the angle θ2 is a negative value.

In addition to the exemplary shapes mentioned here, as seen from a side of the weft holding device, the weft holding portion 7*a* and the weft interfering portion 8*a* may be provided so that either one of the base surface 4 and the opposing surface 6 are formed by a recessed curved surface or a protruding curved surface. Alternatively, the weft holding portion 7*a* and the weft interfering portion 8*a* may be provided so that both of the base surface 4 and the opposing surface 6 have a recessed curved surface or a protruding curved surface. Still alternatively, the base surface 4 and the opposing surface 6 may be formed of a combination of flat surfaces; and, as seen from the top of the rapier head 2 (that is, a side of the weft holding device), the base surface 4 and the opposing surface 6 may be formed of segments at smaller sections. This also applies to the weft guiding portion 9. In order to provide the aforementioned gaps, as shown in FIGS. 10 and 11, only one of the turn-back portion 2*b* and the catch lever 5 may be formed by, for example, a cutting operation to form the gaps. However, as shown in FIG. 12, both of the turn-back portion 2*b* and the catch lever 5 may be formed by a cutting operation to form the gaps.

Figure 14:
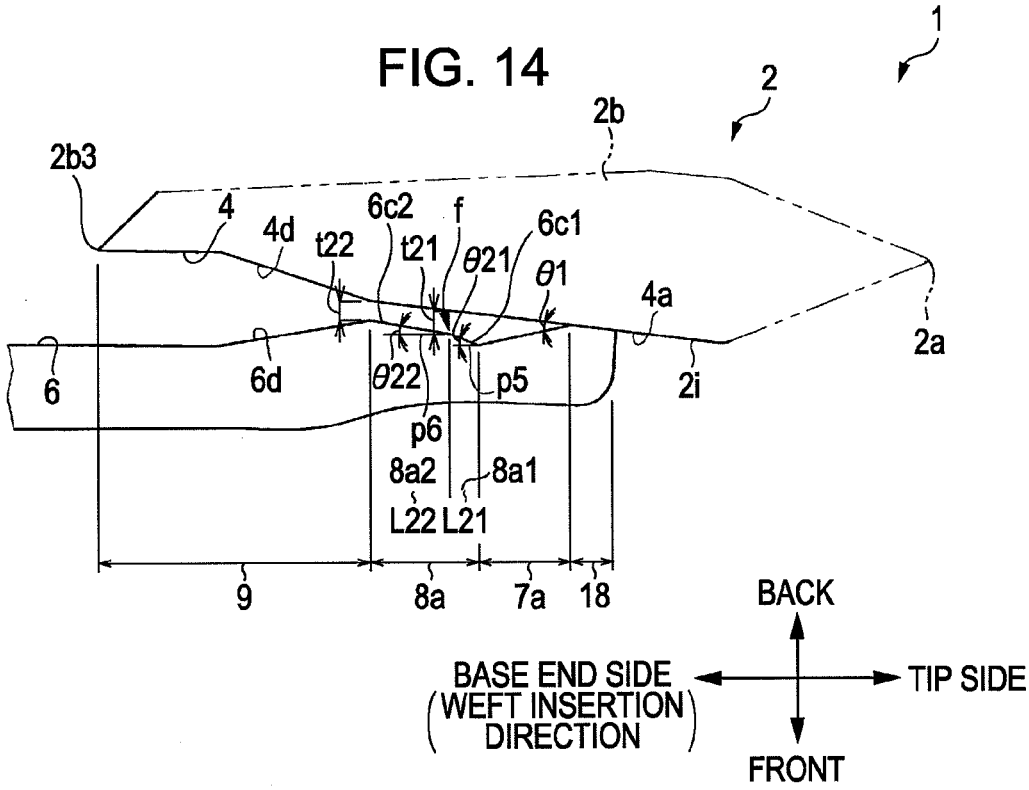
FIG. 14 is an enlarged view of still another modification of the weft holding portion of the carrier rapier according to the present invention.

Instead of forming the base surface 4 or the opposing surface 6 at the weft interfering portion 8*a* using one surface that is continuously curved, the base surface 4 or the opposing surface 6 may be formed of a plurality of segment surfaces having different angles in cross section. For example, FIG. 14 shows an exemplary structure in which the weft interfering portion 8*a* is formed, from the weft holding portion 7*a* side, as two weft interfering portions 8*a*1 and 8*a*2 formed continuously at an intermediate point (indicated by an alphabet "f"); and in which, whereas an opposing surface 6*c*1 at the weft interfering portion 8*a*1 is formed so that an angle θ21 formed with respect to the base surface 4*a* (an imaginary line p5) becomes a negative value (more specifically, −5°), an opposing surface 6*c*2 at the weft interfering portion 8*a*2 is formed so that an angle θ22 formed with respect to the base surface 4*a* (an imaginary line p6) is a value close to zero degrees (more specifically, −1°). The opposing surfaces 6*c*1 and 6*c*2 at the respective areas may be formed so that the angles θ21 and θ22 are less than the angle θ1 and θ1max at the weft holding portion 7*a*, and so that the gaps have sizes that allow the weft 3 as a whole to contact the base surface 4 and the opposing surface 6 and that do not hinder the passage of the weft at the points at minimum intervals t21 and t22 at the weft interfering portion 8*a*1 and 8*a*2. This also similarly applies to section lengths L21 and L22 at the respective weft interfering portions 8*a*1 and 8*a*2. Further, the weft interfering portion 8*a* may be provided as segment lines having three or more different angles.

Figure 15:
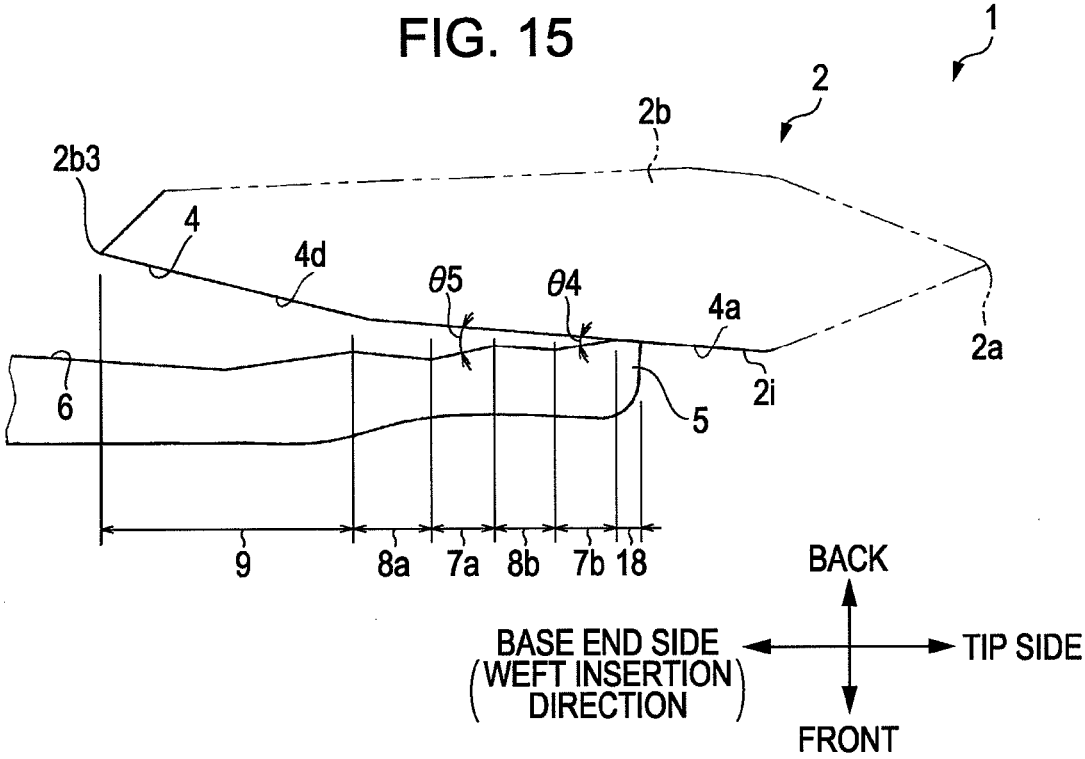
FIG. 15 is an enlarged view of another embodiment (second embodiment) of a weft holding portion of a carrier rapier according to the present invention.
Figure 16:
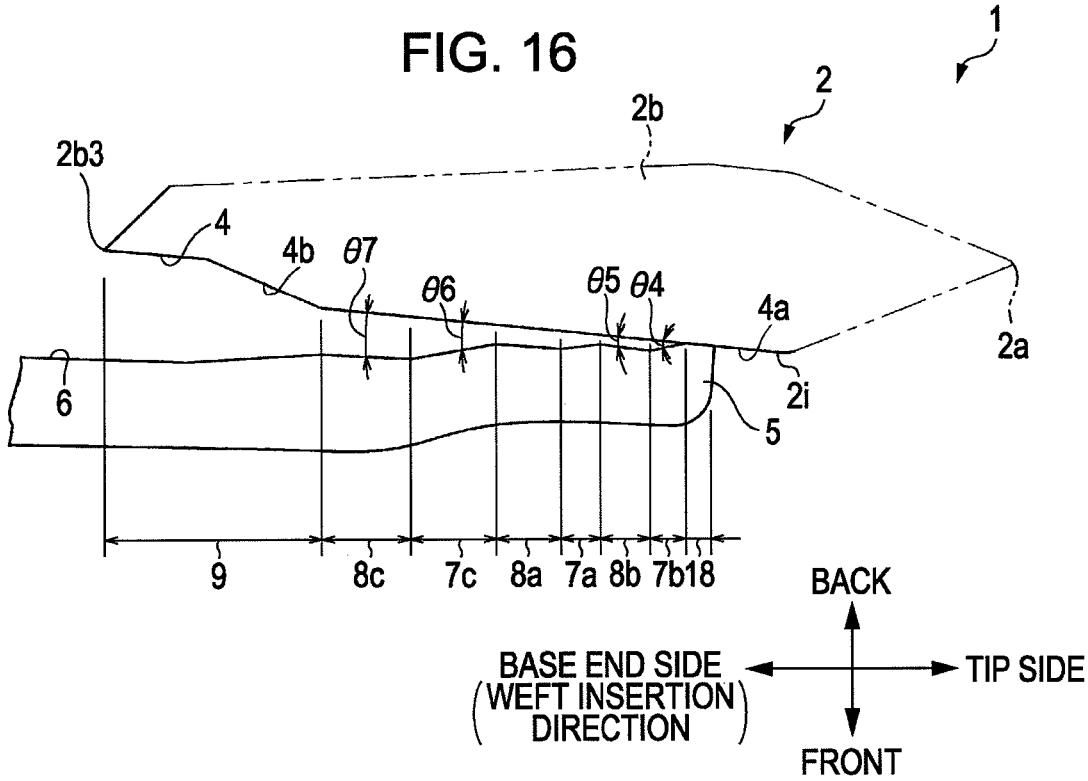
FIG. 16 is an enlarged view of still another embodiment (third embodiment) of a weft holding portion of a carrier rapier according to the present invention.
Figure 17:
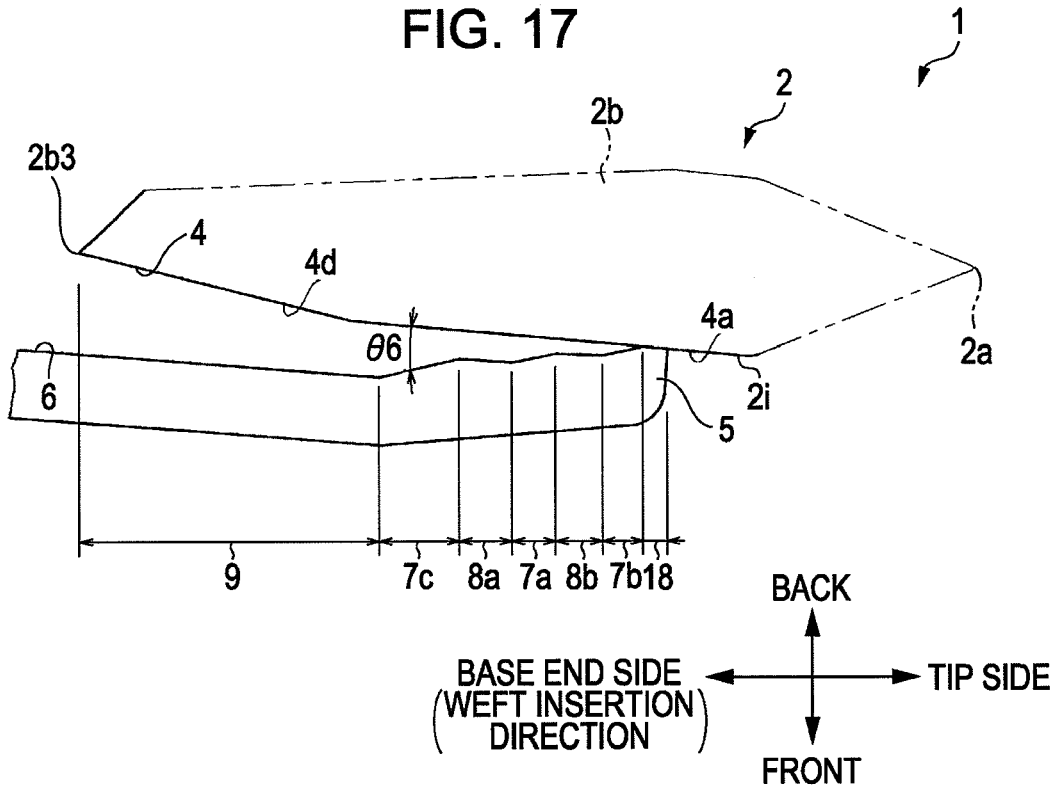
FIG. 17 is an enlarged view of still another embodiment (fourth embodiment) of a weft holding portion of a carrier rapier according to the present invention.

FIGS. 15 to 17 show other embodiments of a carrier rapier to which the present invention is applied. In the embodiment described here, weft holding portions 7*a*, 7*b*, and 7*c* and weft interfering portions 8*a*, 8*b*, and 8*c* having two or more different gap intervals are disposed from a weft guiding portion 9 to a tip 2*a* of a rapier head 2 starting with that having a wide gap, so that one carrier rapier 1 can be used for wefts having different thicknesses, and can perform multi-color insertion using a plurality of wefts whose portions are not aligned as a whole can be performed. In each of the embodiments (drawings) described below, angles θ2 and θ1 formed by a base surface 4 and an opposing surface 6 at a weft interfering portion 8 and a weft holding portion 7 are described without using, for example, imaginary lines and tangential lines as they are used in FIG. 12. Therefore, FIGS. 15 to 17 are simplified.

A carrier rapier 1 according to a second embodiment shown in FIG. 15 includes the thin-weft interfering portion 8*b*, disposed closer to the tip 2*a* of the rapier head 2 than the weft holding portion 7*a* and formed continuously with the weft holding portion 7*a*, and the thin-weft interfering portion 8*b*, disposed closer to the tip 2*a* of the rapier head 2 than the thin-weft interfering portion 8*b* and formed continuously with the thin-weft interfering portion 8*b*. Accordingly, the carrier rapier 1 has a double weft-holding-portion structure. In each of the embodiment and exemplary forms shown in FIGS. 1 to 14, that is, in the carrier rapier 1 having a single weft-holding-portion structure, when a thin weft is held at the interval of the gap at the weft interfering portion 8*a*, a divergence restriction effect and a converging effect of filaments by the weft interfering portion 8*a* cannot be expected. Therefore, in the embodiment, an end of the weft holding portion 7*a* is open, and the thin-weft interfering portion 8*b* and the thin-weft holding portion 7*b* having gap intervals that are narrower than that at the weft interfering portion 8*a* are further provided at a side of the end of the weft holding portion 7*a*.

This makes it possible for the convergence states of wefts having a standard diameter and thin-wefts having diameters that are smaller than the standard diameter to be maintained by the weft interfering portion 8*a* and the thin-weft interfering portion 8*b*. In addition, this makes it possible to hold the wefts having a standard diameter and thin wefts having diameters that are smaller than the standard diameter to be held by the weft holding portion 7*a* and the thin-weft holding portion 7*b*. That is, it is possible to restrict divergence of the weft filaments. Accordingly, one carrier rapier can be used for wefts having different thicknesses and can perform multi-color insertion using a plurality of wefts whose portions are not aligned as a whole can be performed. Obviously, since the carrier rapier 1 according to the embodiment may also be applied to ordinary monochromatic weft insertion, it is not necessary to replace the rapier head 2 (that is, the carrier rapier 1) even if the type of weft is changed.

The relationship between the angle formed by the base surface 4 and the opposing surface 6 at the area of the thin-weft holding portion 7*b* and that formed by the base surface 4 and the opposing surface 6 at the area of the thin-weft interfering portion 8*b* is the same as that between the angle formed at the area of the weft holding portion 7*a* and the angle formed at the area of the weft interfering portion 8*a*. That is, an angle θ5 formed by the base surface 4 and the opposing surface 6 at the area of the thin-weft interfering portion 8*b* is less than a maximum value of an angle θ4 formed by the base surface 4 and the opposing surface 6 at the area of the thin-weft holding portion 7*b*. The dimensional relationships, the shapes, the specific values of the angles, etc., of the base surface 4 and the opposing surface 6 at the thin-weft holding portion 7*b* and at the thin-weft interfering portion 8*b* are similar to those at the weft holding portion 7*a* and the weft interfering portion 8*a*. Therefore, they will not be described.

A carrier rapier 1 according to a third embodiment shown in FIG. 16 corresponds to one in which the rapier head 2 according to the second embodiment shown in FIG. 15 further includes a thick-weft holding portion 7*c* and a thick-weft interfering portion 8*c*. In other words, the carrier rapier 1 according to the third embodiment has a triple weft-holding-portion structure. That is, the thick-weft interfering portion 8*c* and the thick-weft holding portion 7*c* are provided in that order from the base end between a weft guiding portion 9 and a weft interfering portion 8*a*. Accordingly, convergence states of wefts having different diameters, that is, of wefts having a standard diameter, thin wefts having diameters that are smaller than the standard diameter, and thick wefts having diameters that are larger than the standard diameter can be maintained by the thin-weft interfering portion 8*b* and the thick-weft interfering portion 8*c*. In addition, the wefts having different diameters can be held by the weft holding portions corresponding to the respective thicknesses. Even after the wefts are held by the weft holding portions, divergence of filaments at a side opposite to a move-in side of the wefts having different diameters can be restricted by the weft interfering portion 8*a*, the thin-weft interfering portion 8*b*, and the thick-weft interfering portion 8*c*.

The relationship between an angle formed by a base surface 4 and an opposing surface 6 at the area of the thick-weft holding portion 7*c* and that formed by the base surface 4 and the opposing surface 6 at the area of the thick-weft interfering portion 8*c* is the same as that between the angle formed at the area of the weft holding portion 7*a* and the angle formed at the area of the weft interfering portion 8*a*. That is, an angle θ7 formed by the base surface 4 and the opposing surface 6 at the area of the thick-weft interfering portion 8*c* is less than a maximum value of an angle θ6 formed by the base surface 4 and the opposing surface 6 at the area of the thick-weft holding portion 7*c*. The dimensional relationships, the shapes, the specific values of the angles, etc., of the base surface 4 and the opposing surface 6 at the thick-weft holding portion 7*c* and at the thick-weft interfering portion 8*c* are similar to those at the weft holding portion 7*a* and the weft interfering portion 8*a*. Therefore, they will not be described.

A carrier rapier 1 according to a fourth embodiment shown in FIG. 17 corresponds to a carrier rapier in which the rapier head 2 according to the third embodiment shown in FIG. 16 does not include the thick-weft interfering portion 8*c*. In the embodiments shown in FIGS. 15 and 16, in order to make it possible to use a plurality of yarn types having different thicknesses, a plurality of weft holding portions are provided, and a weft interfering portion is provided for every weft holding portion. In the fourth embodiment, weft interfering portions are only provided for yarn types that are difficult to hold, so that weft interfering portions are not provided for yarn types (outside diameters) that are easy to hold. In a modification, the thin-weft interfering portion 8*b* may be omitted from the embodiments shown in FIGS. 15 to 17. This modification is not shown.

In order to make it possible to use yarn types having different outside diameters, a quadruple weft-holding-portion structure and a quadruple weft-interfering-portion structure may be used in addition to the double type and the triple type.

Although, in each of the first to fourth embodiments, the front-side side portion 2*i* of the turn-back portion 2*b* (base section 2*b*1) of the rapier head 2 corresponds to the base surface 4, the carrier rapier may be formed so that the back-side side surface 2*h* shown in FIG. 3 serves as the base surface 4. In each of the embodiments, a side surface adjacent to the inwardly facing surface of the turn-back portion 2*b* corresponds to the base surface. However, instead, the carrier rapier may have the inwardly facing surface of the turn-back portion 2*b* serving as the base surface.

Figure 18:
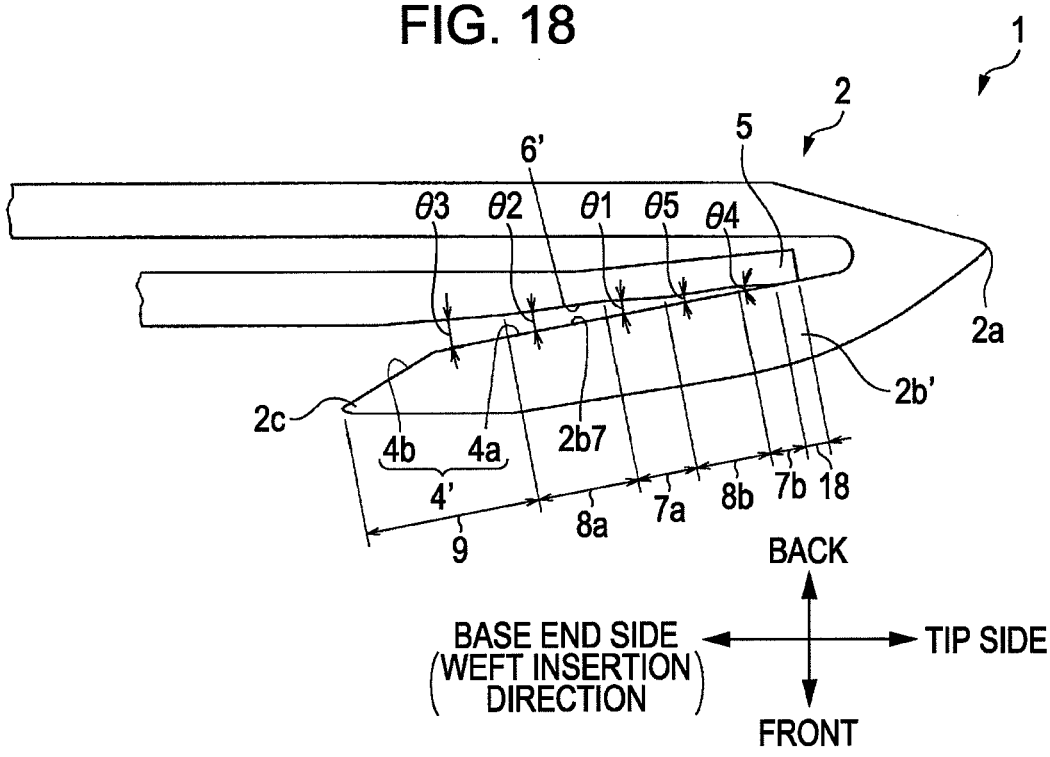
FIG. 18 is an enlarged view of still another embodiment (fifth embodiment) of a weft holding portion of a carrier rapier according to the present invention.

FIG. 18 shows a carrier rapier 1 according to a fifth embodiment, in which the carrier rapier 1 is seen from above the carrier rapier 1, a tip 2*a* of the carrier rapier 1 is oriented rightwards, and a weft holding portion 7*a* is seen from a side so that a base surface of a weft holding portion is disposed above an opposing surface of a catch lever. The carrier rapier 1 according to the fifth embodiment has a base surface 4' formed at an inwardly facing surface 2*b*7 of a turn-back portion 2*b*', and is one to which is applied a double structure according to the present invention shown in FIG. 10 that allows the use of wefts having a standard outside diameter and thin wefts. A catch lever 5, which is not shown in detail, is biased against the base surface 4', and contacts the base surface 4' at a contact portion 18 at its end. The base surface 4' at the turn-back portion 2*b* and an opposing surface 6' of the catch lever 5 form a thin-weft holding portion 7*b*, a thin-weft interfering portion 8*b*, a weft holding portion 7*a*, a weft interfering portion 8*a*, and a weft guiding portion 9 in that order from the tip side of the rapier head 2.

In the above-described embodiment, the opposing surface 6 of the catch lever 5 and the base surface 4 at the turn-back portion 2*b* of the rapier head 2, which form the weft holding portion 7*a*, the weft interfering portion 8*a*, etc., are both smooth without recesses and protrusions as seen in cross section of the weft holding portion 7*a*. However, either one or both of the opposing surface 6 and the base surface 4 may have recesses and protrusions. More specifically, it is possible to provide one or more protruding portions 10 protruding from at least one of the catch lever 5 and the turn-back portion 2*b* towards the other side, and to cause the one or more protruding portions to extend to at least the area of the weft interfering portion 8*a* or the area of the thin-weft holding portion 7*b* from the weft holding portion 7*a*, so that the weft holding force of the carrier rapier 1 with respect to a weft 3 is increased.

FIGS. 19A to 19C are each a sectional view in which the first embodiment (shown in FIG. 5) is used as a base; in which, at a weft interfering portion 8*a* and a contact portion 18, a base surface 4 at a turn-back portion 2*b* of the rapier head 2 and an opposing surface 6 of a catch lever 5 are cross-sectioned perpendicularly to the longitudinal direction of the carrier rapier 1; and in which the cross-sectional shapes of these members and combinations thereof are shown. Here, in FIG. 19A, the base surface 4 and the opposing surface 6 are both flat surfaces in accordance with the first embodiment. In FIG. 19B, wavy grooves are formed to provide a plurality of protruding portions 10 in only the opposing surface 6. Further, in FIG. 19C, a plurality of wavy grooves are formed in both of the base surface 4 and the opposing surface 6, and engage each other.

In these embodiments, the wavy surface having recesses and protrusions in cross section correspond to the base surface 4 or the opposing surface 6. If the protruding portions 10 (grooves) are formed in at least one of the base surface 4 and the opposing surface 6, they can mesh with a weft 3 when the weft 3 is held, so that the weft holding force of the weft holding portions 7*a*, 7*b*, and 7*c* can be increased. Instead of engaging the wavy grooves (wavy surfaces), edges may be provided so as to oppose each other. Such wavy grooves (wavy surfaces) are formed from the weft holding portion 7*a* to the weft interfering portion 8*a*. However, they may be formed so as to reach either one or both of the weft guiding portion 9 and the contact portion 18. The aforementioned points and the content of the following description are similarly applicable to the second to fifth embodiments.

The number of protruding portions 10 (grooves) of the opposing surface 6 and the base surface 4 may be more than one as viewed in the aforementioned cross sections. The protruding portions 10 (grooves) may be, for example, arch-shaped, rectangular, saw-blade shaped, or wavy. A suitable shape may be used in accordance with the type of weft 3. When at least one of the base surface 4 and the opposing surface 6 is provided with protruding portions 10 (grooves), the angle formed by the base surface 4 and the opposing surface 6 at the weft holding portion 7*a* and the angle formed by the base surface 4 and the opposing surface 6 at the weft interfering portion 8*a* correspond to angles formed by respective tangential lines at the planes where the grooved base surface 4 and the grooved opposing surface 6 contact the weft 3 (that is, more simply, the angles formed by tangential lines at valley lines and edge lines at the opposing surface). The protruding portions 10 (grooves) may be provided at the thin-weft holding portion 7*b*, the thick-weft holding portion 7*c*, the thin-weft interfering portion 8*b*, and the thick-weft holding portion 8*c* in addition to the weft holding portion 7*a* and the weft interfering portion 8*a*.

Figure 20A:
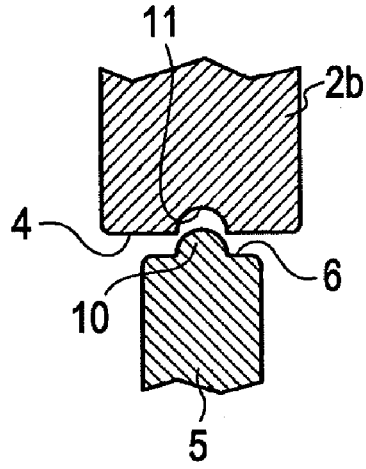
FIGS. 20A to 20C are each a sectional view of a turn-back portion of a rapier head and a catch lever 5, each being a sectional view at the weft interfering portion.
Figure 20B:
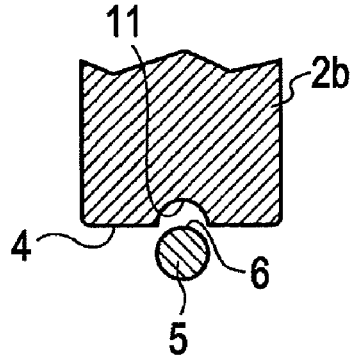
Figure 20C:
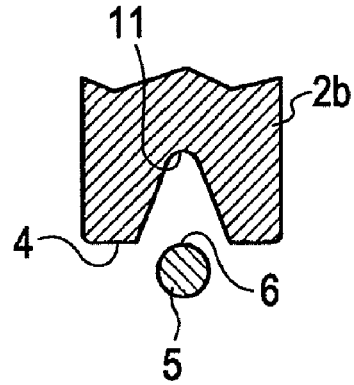
Figure 21A:
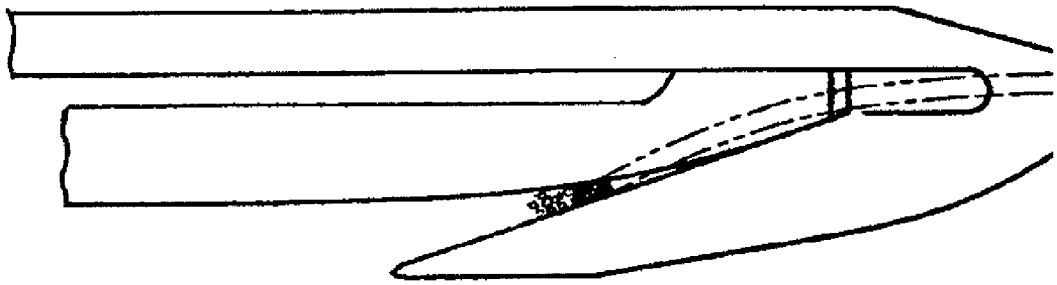
FIGS. 21A and 21B are, respectively, an enlarged plan view and an enlarged side view of the main portion of a related carrier rapier.
Figure 21B:
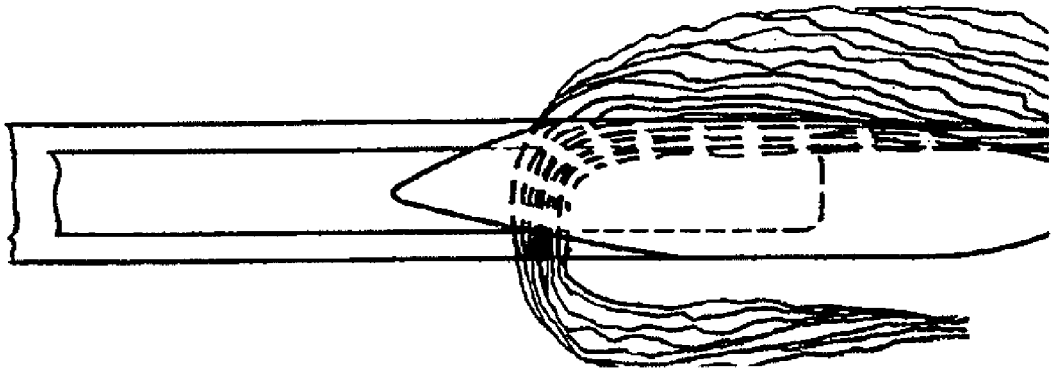

FIGS. 20A to 20C each show an exemplary cross-sectional shape that is formed when a turn-back portion 2*b* of a rapier head 2 and a catch lever 5 are cross-sectioned perpendicularly to a longitudinal direction of a carrier rapier 1. In FIG. 20A, a groove that is arch-shaped in cross section is provided in the base surface 4 at the turn-back portion 2*b* so as to extend longitudinally, and a protruding portion 10 having a semi-arched shape and fitting to the groove is formed at an opposing surface 6 of the catch lever 5 so as to protrude from a base and extend longitudinally. The catch lever 5 need not be a flat opposing surface. The catch lever 5 may be, for example, a curved surface when viewed in cross section.

FIG. 20B shows an example in which a groove having a semi-arched shape in cross section is provided in an end surface of the turn-back portion 2*b* so as to extend longitudinally, and in which the catch lever 5 is a round rod that fits in the semi-arched groove. FIG. 20C shows an example in which a reversed V-shaped groove is provided in the end surface of the turn-back portion 2*b* in cross section so as to extend longitudinally, and in which the catch lever 5 is a round rod that fits in the V-shaped groove. In this example, the catch lever 5 is not in line-contact with and does not closely contact the base surface 4 at the turn-back portion 2*b*. Therefore, excessive stress is not applied to a weft 3. Even in the examples shown in FIGS. 20A to 20C, the base surface and the opposing surface are grooved or protruding surfaces that actually engage (contact) the weft 3. As regards, for example, the angles formed by the two surfaces at the area of the weft holding portion 7*a* and the area of the weft interfering portion 8*a*, respectively, and the gaps at the weft holding portion 7*a* and the weft interfering portion 8*a*, respectively, the invention of the application includes those that do not depart from the gist of the present invention.

The carrier rapier according to the present invention may have the following forms. Although, in the fifth embodiment (FIG. 18), the opposing surface of the catch lever 5 having the opposing surface is mounted to base surface so as to press the base surface with a support shaft (not shown) as center, the present invention is not limited to this form. For example, the present invention is applicable to a carrier rapier in which a catch lever 5 is provided so as to be slidable longitudinally along a groove formed at the inner side of the base portion 2*f*, and in which a weft can be freed by longitudinal movement of the catch lever 5.

The rapier loom to which the carrier rapier according to the present invention is applied is not limited to a both-side rapier loom including an insert rapier. The present invention is also applicable to a carrier rapier in which a base surface is provided at either one of a side surface and an inwardly facing surface at a turn-back portion in a one-side rapier loom, such as that described in the background art, in which weft insertion is performed with a rapier head provided opposite to a yarn-feeding side.

What is claimed is:

1. A carrier rapier comprising:

a hook-shaped rapier head having a base portion that extends to a tip of the rapier head and a turn-back portion that is turned back from a side of the tip of the rapier head towards a base end, a base surface being formed at either of an inwardly facing surface and a side surface of the turn-back portion; and a catch lever having an opposing surface opposing the base surface, the catch lever biased in a direction in which the catch lever presses the base surface and being mounted to the rapier head, wherein the base surface and the opposing surface form a weft holding portion and a weft guiding portion that is disposed closer to a tip of the turn-back portion than the weft holding portion, wherein the weft holding portion is such that a gap provided between the base surface and the opposing surface becomes gradually smaller from a side of the tip of the turn-back portion towards the tip of the rapier head, and the weft holding portion is provided at the gap that is capable of holding a weft, wherein the weft provided from the side of the tip of the turn-back portion and through the weft guiding portion is moved into and held by the weft holding portion, wherein a weft interfering portion is provided between the weft holding portion and the weft guiding portion, the weft interfering portion having a predetermined length in a longitudinal direction of the rapier head, and wherein an angle formed by the base surface and the opposing surface at an area of the weft interfering portion is less than a maximum value of an angle formed by the base surface and the opposing surface at an area of the weft holding portion.

2. The carrier rapier according to claim 1, wherein the predetermined length of the weft interfering portion is greater than or equal to 0.5 mm.

3. The carrier rapier according to claim 2, wherein at least one of the base surface and the opposing surface at the weft interfering portion is curved when viewed from a side of the weft holding portion, and wherein an angle formed by a tangential line of the one of the surfaces that is curved and a tangential line of the other surface that is linear or that is curved at the area of the weft interfering portion is less than the maximum value of the angle formed by the base surface and the opposing surface at the area of the weft holding portion.

4. The carrier rapier according to claim 3, wherein the angle formed by the base surface and the opposing surface in the area of the weft interfering portion includes a negative value.

5. The carrier rapier according to claim 3, wherein the angle formed by the base surface and the opposing surface in the area of the weft interfering portion is zero degrees.

6. The carrier rapier according to any one of claims 1 to 5, wherein one or more protruding portions are provided at least one of the catch lever and the turn-back portion so as to extend from the weft holding portion to at least an interior of the area of the weft interfering portion, the one or more protruding portions protruding towards the other of the catch lever and the turn-back portion in cross section that is perpendicular to a longitudinal direction of the carrier rapier, and wherein the one or more protruding portions are provided so that at least one of the base surface and the opposing surface has one or more protruding portions provided by the one or more protrusions in the cross section that is perpendicular to the longitudinal direction of the carrier rapier.

7. The carrier rapier according to claim 1, wherein the maximum value of the angle formed by the base surface and the opposing surface at the area of the weft holding portion is at least 2° to 10° at most.

8. The carrier rapier according to claim 1, wherein the base surface and the opposing surface form a thin-weft interfering portion and a thin-weft holding portion, the thin-weft interfering portion being disposed closer to the tip of the carrier rapier than the weft holding portion and being continuously disposed with the weft holding portion, the thin-weft holding portion being disposed closer to the tip of the carrier rapier than the thin-weft interfering portion and being continuously disposed with the thin-weft interfering portion, wherein the thin-weft holding portion is such that a gap provided between the base surface and the opposing surface becomes gradually smaller, and the thin-weft holding portion is provided so as to be capable of holding a weft that is thinner than the weft held by the weft holding portion, and wherein the thin-weft interfering portion has a predetermined length in the longitudinal direction of the carrier rapier, and an angle formed by the base surface and the opposing surface at an area of the thin-weft interfering portion is less than a maximum value of an angle formed by the base surface and the opposing surface at an area of the thin-weft holding portion.

9. The carrier rapier according to claim 8, wherein the predetermined length of the thin-weft interfering portion is greater than or equal to 0.5 mm.

10. The carrier rapier according to claim 9, wherein at least one of the base surface and the opposing surface at the thin-weft interfering portion is curved when viewed from a side of the weft holding portion, and wherein an angle formed by a tangential line of the one of the surfaces that is curved and a tangential line of the other surface that is linear or that is curved at the area of the thin-weft interfering portion is less than the maximum value of the angle formed by the base surface and the opposing surface at the area of the thin-weft holding portion.

11. The carrier rapier according to claim 10, wherein the angle formed by the base surface and the opposing surface in the area of the thin-weft interfering portion includes a negative value.

12. The carrier rapier according to any one of claims 8 to 11, wherein one or more protruding portions are provided at least one of the catch lever and the turn-back portion so as to extend from the weft holding portion to at least the area of the thin-weft interfering portion, the one or more protruding portions protruding towards the other of the catch lever and the turn-back portion in cross section that is perpendicular to the longitudinal direction of the carrier rapier, and wherein the one or more protruding portions are provided so that at least one of the base surface and the opposing surface has one or more protruding portions provided by the one or more protrusions in the cross section that is perpendicular to the longitudinal direction of the carrier rapier.

13. The carrier rapier according to claim 8, wherein the maximum value of the angle formed by the base surface and the opposing surface at the area of the thin-weft holding portion is at least 2° to 10° at most.

14. The carrier rapier according to claim 8, wherein a thick-weft holding portion is further provided between the weft interfering portion and the weft guiding portion, the thick-weft holding portion being disposed continuously with the weft interfering portion, and wherein the thick-weft holding portion is such that a gap provided between the base surface and the opposing surface becomes gradually larger from the weft interfering portion towards the tip of the turn-back portion, and is provided so as to be capable of holding a weft that is thicker than the weft that is capable of being held by weft holding portion.

15. The carrier rapier according to claim 14, wherein a thick-weft interfering portion is further provided between the thick-weft holding portion and the weft guiding portion, the thick-weft interfering portion being continuously disposed with the thick-weft holding portion, and wherein the thick-weft interfering portion has a predetermined length in the longitudinal direction of the carrier rapier, and an angle formed by the base surface and the opposing surface at an area of the thick-weft interfering portion is less than a maximum value of an angle formed by the base surface and the opposing surface at an area of the thick-weft holding portion.

16. The carrier rapier according to claim 15, wherein the predetermined length of the thick-weft interfering portion is greater than or equal to 0.5 mm.

17. The carrier rapier according to claim 16, wherein at least one of the base surface and the opposing surface at the thick-weft interfering portion is curved when viewed from a side of the weft holding portion, and wherein an angle formed by a tangential line of the one of the surfaces that is curved and a tangential line of the other surface that is linear or that is curved at the area of the thick-weft interfering portion is less than the maximum value of the angle formed by the base surface and the opposing surface at the area of the thick-weft holding portion.

18. The carrier rapier according to claim 17, wherein the angle formed by the base surface and the opposing surface in the area of the thick-weft interfering portion includes a negative value.

19. The carrier rapier according to claim 18, wherein the maximum value of the angle formed by the base surface and the opposing surface at the area of the thick-weft holding portion is at least 2° to 10° at most.

* * * * *